US012768600B2

(12) United States Patent
Wang

(10) Patent No.: US 12,768,600 B2
(45) Date of Patent: Oct. 20, 2026

(54) TRIANGULAR HEAT EXCHANGER

(71) Applicant: ZHEJIANG DUNAN ARTIFICIAL ENVIRONMENT CO., LTD., Shaoxing (CN)

(72) Inventor: Guanjun Wang, Shaoxing (CN)

(73) Assignee: ZHEJIANG DUNAN ARTIFICIAL ENVIRONMENT CO., LTD., Shaoxing (CN)

( * ) Notice: Subject to any disclaimer, the term of this patent is extended or adjusted under 35 U.S.C. 154(b) by 119 days.

(21) Appl. No.: 18/688,350

(22) PCT Filed: Aug. 31, 2022

(86) PCT No.: PCT/CN2022/116337
§ 371 (c)(1),
(2) Date: Feb. 29, 2024

(87) PCT Pub. No.: WO2023/030416
PCT Pub. Date: Mar. 9, 2023

(65) Prior Publication Data

US 2024/0384938 A1 Nov. 21, 2024

(30) Foreign Application Priority Data

Aug. 31, 2021 (CN) ..... 202111017346.9
Aug. 31, 2021 (CN) ..... 202111017351.X
(Continued)

(51) Int. Cl.
*F28F 1/04* (2006.01)
*F28D 1/02* (2006.01)
(Continued)

(52) U.S. Cl.
CPC ..... *F28D 7/1653* (2013.01); *F28F 1/04* (2013.01); *F28F 9/02* (2013.01); *F28D 2001/0273* (2013.01)

(58) Field of Classification Search
CPC ... F28D 7/1653; F28D 2001/0273; F28F 1/04
See application file for complete search history.

(56) References Cited

U.S. PATENT DOCUMENTS 4,832,116 A * 5/1989 Easton ..... F01P 11/12 165/95
5,341,870 A * 8/1994 Hughes ..... F28F 3/025 165/110
(Continued)

FOREIGN PATENT DOCUMENTS

CN 201731683 2/2011
CN 105698383 6/2016
(Continued)

OTHER PUBLICATIONS

Translation of JP2021063599A named Translation-JP2021063599A (Year: 2021).*
(Continued)

*Primary Examiner* — Paul Alvare
(74) *Attorney, Agent, or Firm* — The Sun IP Law

(57) ABSTRACT

A heat exchanger, including: a first heat exchange portion, the first heat exchange portion including a plurality of first flat tubes disposed at intervals, each first flat tube including a first heat exchange tube section and a second heat exchange tube section connected with each other, the first heat exchange tube section and the second heat exchange tube section being disposed at a preset angle; a first manifold and a second manifold, the first heat exchange tube sections of the plurality of first flat tubes all being connected with the first manifold, and the second heat exchange tube sections of the plurality of first flat tubes being connected with the second manifold; and a second heat exchange portion, disposed at the end portion of the first heat exchange portion,
(Continued)

the first heat exchange portion and the second heat exchange portion enclosing to form an air duct.

4 Claims, 31 Drawing Sheets

(30) Foreign Application Priority Data

| | | |
|---|---|---|
| Aug. 31, 2021 | (CN) | 202122084091.X |
| Aug. 31, 2021 | (CN) | 202122087044.0 |
| Aug. 31, 2021 | (CN) | 202122089025.1 |
| Aug. 31, 2021 | (CN) | 202122092336.3 |

(51) Int. Cl.
*F28D 7/16* (2006.01)
*F28F 9/02* (2006.01)

(56) References Cited

U.S. PATENT DOCUMENTS

| | | | | |
|---|---|---|---|---|
| 10,378,825 | B2 * | 8/2019 | Yang | F28F 9/026 |
| 10,801,783 | B2 * | 10/2020 | Jin | F28D 1/05325 |
| 2011/0094257 | A1 | 4/2011 | Rusignuolo | |
| 2011/0315362 | A1 * | 12/2011 | Jiang | F28D 1/05375 165/173 |
| 2017/0130974 | A1 * | 5/2017 | Mercer | F24F 1/56 |
| 2020/0033072 | A1 * | 1/2020 | Zhang | F28D 1/0417 |

FOREIGN PATENT DOCUMENTS

| | | | | |
|---|---|---|---|---|
| CN | 205717905 | | | 11/2016 |
| CN | 205784008 | | | 12/2016 |
| CN | 107664366 | | | 2/2018 |
| CN | 206959637 | | | 2/2018 |
| CN | 206959637 | U | * | 2/2018 |
| CN | 216159687 | | | 4/2022 |
| CN | 216159688 | U | | 4/2022 |
| CN | 216159689 | U | | 4/2022 |
| CN | 216159690 | U | | 4/2022 |
| JP | H0611280 | A | | 1/1994 |
| JP | 2017514089 | A | | 6/2017 |
| JP | 2021063599 | A | * | 4/2021 |
| KR | 100265657 | B1 | | 9/2000 |
| KR | 20190008260 | A | | 1/2019 |
| WO | 2021079422 | A1 | | 4/2021 |

OTHER PUBLICATIONS

Translation of CN206959637U named Translation-CN206959637U (Year: 2018).*

The first Office Action of counterpart JP application No. 2024-503379 issued on May 16, 2025.

The first Office Action of counterpart KR application No. 10-2024-7005860 issued on Dec. 19, 2025.

* cited by examiner

TRIANGULAR HEAT EXCHANGER

CROSS-REFERENCE TO RELATED APPLICATION

The disclosure is a national stage application of International Patent Application No. PCT/CN2022/116337, which is filed on Aug. 31, 2022, and claims the priority to Patent application No. 202111017351.X, entitled "Heat Exchanger", and filed to the Chinese Patent Office on Aug. 31, 2021, Patent Application No. 202122087044.0, entitled "Heat Exchanger", and filed to the Chinese Patent Office on Aug. 31, 2021, Patent Application No. 202111017346.9, entitled "Heat Exchanger", and filed to the Chinese Patent Office on Aug. 31, 2021, Patent Application No. 202122092336.3, entitled "Heat Exchanger", and filed to the Chinese Patent Office on Aug. 31, 2021, Patent Application No. 202122089025.1, entitled "Heat Exchanger", and filed to the Chinese Patent Office on Aug. 31, 2021, and Patent Application No. 202122084091.X, entitled "Heat Exchanger", and filed to the Chinese Patent Office on Aug. 31, 2021.

TECHNICAL FIELD

The disclosure relates to the technical field of heat exchangers, and in particular to a heat exchanger.

BACKGROUND

At present, for the installation and wind shield of conventional bent heat exchangers in the art known to inventors, a sheet metal member is generally used to shield side edges of A-type heat exchangers (i.e., the heat exchanger having a bent flat tube).

However, if the described structure arrangement is used, the occupied area is large, the area is wasted, the structure is not compact enough, the heat exchange area is limited, and the heat exchange performance cannot be effectively improved.

SUMMARY

A main objective of the disclosure is to provide a heat exchanger, so as to solve the technical problem of poor heat exchange performance of A-type heat exchangers in the art known to inventors.

In order to achieve the above objective, the present disclosure provides a heat exchanger, including: a first heat exchange portion, wherein the first heat exchange portion includes a plurality of first flat tubes disposed at intervals, each of the plurality of first flat tubes includes a first heat exchange tube section and a second heat exchange tube section connected with each other, and the first heat exchange tube section and the second heat exchange tube section are disposed at a preset angle; or the first heat exchange portion includes a first heat exchange assembly and a second heat exchange assembly connected with each other, the first heat exchange assembly includes a plurality of first heat exchange flat tubes disposed at intervals in a first preset direction, the second heat exchange assembly includes a plurality of second heat exchange flat tubes disposed at intervals in a second preset direction, and the first preset direction is disposed at a preset angle to the second preset direction; a first manifold and a second manifold, wherein first heat exchange tube sections of the plurality of first flat tubes are all connected with the first manifold, and second heat exchange tube sections of the plurality of first flat tubes are connected with the second manifold; or the plurality of first heat exchange flat tubes are all connected with the first manifold, and the plurality of second heat exchange flat tubes are all connected with the second manifold; a second heat exchange portion disposed at an end portion of the first heat exchange portion, the first heat exchange portion and the second heat exchange portion enclosing to form an air duct.

In some embodiments, an installation region is arranged between the first heat exchange tube sections and the second heat exchange tube sections, and the second heat exchange portion is disposed in the installation region.

In some embodiments, the installation region is a triangular region, the second heat exchange portion is of a triangular structure or a trapezoidal structure fitting the installation region, and the second heat exchange portion is at least partially fitted to the first heat exchange tube sections and the second heat exchange tube sections.

In some embodiments, an angle between the first heat exchange tube section and the second heat exchange tube section forms an apex angle of the triangular region, and the apex angle of the triangular region is as same as an apex angle of the triangular structure.

In some embodiments, the second heat exchange portion includes a second flat tube, the second flat tube includes a plurality of bent tube sections connected in sequence, and heights of the plurality of bent tube sections connected in sequence gradually increase first and then gradually decrease, so that edges of the plurality of bent tube sections connected in sequence enclose to form the triangular structure.

In some embodiments, the second heat exchange portion includes a second flat tube and second fins, the second flat tube includes a plurality of bent tube sections connected in sequence, and heights of the plurality of bent tube sections connected in sequence gradually increase first and then decrease, there are a plurality of second fins, and the plurality of second fins are installed in a bending gap of each of the plurality of bent tube sections connected in sequence and between two adjacent bent tube sections of the plurality of bent tube sections connected in sequence; wherein the two adjacent bent tube sections of the plurality of bent tube sections connected in sequence include a first bent tube section and a second bent tube section, a height of the first bent tube section, a height of a second fin of the plurality of second fins disposed between the first bent tube section and the second bent tube section, and a height of the second bent tube section gradually increase or decrease in sequence, so that an edge of the second flat tube and edges of the plurality of second fins enclose to form the triangular structure.

In some embodiments, an inlet end of the second heat exchange portion is in communication with the first manifold, and an outlet end of the second heat exchange portion is in communication with the second manifold.

In some embodiments, the second heat exchange portion includes a second flat tube; a first insertion slot is arranged on the first manifold, the first insertion slot extends in an axial direction of the first manifold, and one end of the second flat tube is inserted into the first insertion slot; or a second insertion slot is arranged on the second manifold, the second insertion slot extends in an axial direction of the second manifold, and an other end of the second flat tube is inserted into the second insertion slot.

In some embodiments, the second heat exchange portion includes a third manifold, a fourth manifold and a second flat tube, the second flat tube is in communication with the third manifold and the fourth manifold respectively, and the third manifold and the fourth manifold are in communication with the first manifold and the second manifold respectively by means of connecting tubes.

In some embodiments, there are two second heat exchange portions, the two second heat exchange portions are respectively disposed at two ends of the first heat exchange portion, inlet ends of the two second heat exchange portions are connected by means of a first connecting tube, and outlet ends of the two second heat exchange portions are connected by means of a second connecting tube; the heat exchanger further includes a third connecting tube and a fourth connecting tube that are disposed at intervals, the third connecting tube and the fourth connecting tube are both disposed on one of the two second heat exchange portions, the third connecting tube is disposed between the one of the two second heat exchange portions and the first manifold, and the fourth connecting tube is disposed between the one of the two second heat exchange portions and the second manifold; or the two second heat exchange portions and the first heat exchange portion are disposed independently of each other, so that the two second heat exchange portions and the first heat exchange portion exchange heat independently.

In some embodiments, there are two second heat exchange portions, and the two second heat exchange portions are respectively disposed at two ends of the first heat exchange portion; inlet ends of the two second heat exchange portions are both connected with a side portion of the first manifold, and outlet ends of the two second heat exchange portions are both connected with a side portion of the second manifold; a connection between an inlet end of one of the two second heat exchange portions and the first manifold and a connection between an inlet end of an other of the two second heat exchange portions and the first manifold are respectively disposed at two ends of the first heat exchange portion; and a connection between an outlet end of one of the two second heat exchange portions and the second manifold and a connection between an outlet end of the other of the two second heat exchange portions and the second manifold are respectively disposed at two ends of the first heat exchange portion; or the heat exchanger further includes two first tubes and two second tubes, one end of one of the two first tubes and one end of an other of the two first tubes are connected with two ends of the first manifold respectively, and an other end of one of the two first tubes and an other end of the other of the two first tubes are connected with inlet ends of the two second heat exchange portions respectively; one end of one of the two second tubes and one end of an other of the two second tubes are connected with two ends of the second manifold respectively, and an other end of one of the two second tubes and an other end of the other of the two second tubes are connected with outlet ends of the two second heat exchange portions respectively.

In some embodiments, the second heat exchange portion is disposed to be inclined to an inner side of the installation region.

In some embodiments, the second heat exchange portion has a top end and a bottom end opposite to each other, the top end of the second heat exchange portion is disposed at a connection between the first heat exchange tube section and the second heat exchange tube section, and the bottom end of the second heat exchange portion is disposed at an end of the first heat exchange tube section away from the second heat exchange tube section; wherein the top end of the second heat exchange portion is disposed to be inclined to an inner side of the installation region relative to the bottom end of the second heat exchange portion.

In some embodiments the heat exchanger further includes: a intermediate manifold, wherein the intermediate manifold has an inlet tube section and an outlet tube section independent of each other, an inlet end of the second heat exchange portion is connected with the inlet tube section, and an outlet end of the second heat exchange portion is connected with the outlet tube section; an inlet end of the inlet tube section is connected with the first manifold, and an outlet end of the outlet tube section is connected with the second manifold.

In some embodiments, the second heat exchange portion includes at least two heat exchange structures independently arranged, there are at least two intermediate manifolds, and the at least two heat exchange structures are disposed at intervals along an extension direction from one end of the first heat exchange portion to an other end of the first heat exchange portion; the at least two heat exchange structures and the at least two intermediate manifolds are disposed in a correspondingly manner, and each of the at least two heat exchange structures is connected with a corresponding intermediate manifold of the at least two intermediate manifolds.

In some embodiments, the second heat exchange portion includes two heat exchange structures independently arranged, and the two heat exchange structures are respectively disposed at two ends of the first heat exchange portion; there are two intermediate manifolds, the two heat exchange structures and the two intermediate manifolds are disposed in a one-to-one correspondingly manner, and each of the two heat exchange structures is connected with a corresponding intermediate manifold of the two intermediate manifolds.

In some embodiments, an installation region is arranged between the first heat exchange tube sections and the second heat exchange tube sections, the installation region is a triangular region, the at least two heat exchange structures are installed in the triangular region, and an appearance of each of the at least two heat exchange structures is a triangular or trapezoidal structure fitting the installation region, each of the at least two heat exchange structures is at least partially fitted to the first heat exchange tube sections or the second heat exchange tube sections.

In some embodiments, each of the at least two heat exchange structures includes a plurality of third flat tubes disposed at intervals in a height direction, inlet ends of the plurality of third flat tubes are connected with the inlet tube section, and outlet ends of the plurality of third flat tubes are connected with the outlet tube section.

In some embodiments, each of the plurality of third flat tubes includes a first tube section, a second tube section and a third tube section which are connected in sequence; the first tube section and the third tube section all extend in a vertical direction or in a direction forming a predetermined angle with the vertical direction; the second tube section extend in a horizontal direction or in a direction forming a predetermined angle with the horizontal direction; one end of the first tube section away from the second tube section forms an inlet end of each of the plurality of third flat tubes; and one end of the third tube section away from the second tube section forms an outlet end of each of the plurality of third flat tubes.

In some embodiments, in an extension direction from a bottom end of each of the at least two heat exchange structures to a top end of each of the at least two heat exchange structures, lengths of a plurality of second tube sections of the plurality of third flat tubes gradually decrease, and lengths of a plurality of first tube sections of the plurality of third flat tubes or lengths of a plurality of third tube sections of the plurality of third flat tubes gradually increase.

In some embodiments, each of the plurality of third flat tubes is of an integrally formed structure; a connection between the first tube section and the second tube section is an arc-shaped bent transition structure; or a connection between the second tube section and the third tube section is an arc-shaped bent transition structure.

In some embodiments, the heat exchanger further includes a connecting pipe, and the connecting pipe and the intermediate manifold are respectively disposed at two ends of the first heat exchange portion; the second heat exchange portion includes: two heat exchange structures in communication with each other, wherein the two heat exchange structures are respectively disposed at two ends of the first heat exchange portion, one of the two heat exchange structures is connected with the connecting pipe, and an other one of the two heat exchange structures is connected with the intermediate manifold, so that fluid entering through the inlet tube section is discharged from the outlet tube section after passing through the two heat exchange structures.

In some embodiments, the second heat exchange portion further includes: a fourth flat tube, the fourth flat tube including a fourth tube section, a fifth tube section and a sixth tube section which are sequentially connected, the fourth tube section and the sixth tube section both extending in a vertical direction or in a direction forming a predetermined angle with the vertical direction, the fourth tube section being disposed at one end of the first heat exchange portion and is connected with the intermediate manifold, the fifth tube section being disposed between one end of the first heat exchange portion and an other end of the first heat exchange portion, and the sixth tube section being disposed at the other end of the first heat exchange portion and is connected with the connecting pipe; wherein there are a plurality of fourth flat tubes, the plurality of fourth flat tubes are disposed at intervals in an extension direction of the intermediate manifold, a plurality of fourth tube sections of the plurality of fourth flat tubes enclose to form one heat exchange structure of the two heat exchange structures, a plurality of sixth tube sections of the plurality of fourth flat tubes enclose to form another heat exchange structure of the two heat exchange structures, and the one heat exchange structure of the two heat exchange structures is connected with the other heat exchange structure of the two heat exchange structures by means of a plurality of fifth tube sections of the plurality of fourth flat tubes.

In some embodiments, an installation region is arranged between the first heat exchange tube sections and the second heat exchange tube sections, the installation region is a triangular region, and the two heat exchange structures are at least partially fitted to the first heat exchange tube sections or the second heat exchange tube sections; in the extension direction of the intermediate manifold, lengths of the plurality of fourth tube sections of the plurality of fourth flat tubes firstly increase and then decrease, so that the plurality of fourth tube sections of the plurality of fourth flat tubes form a triangle structure or a trapezoid structure fitting the installation region; or in the extension direction of the intermediate manifold, lengths of the plurality of six tube sections of the plurality of fourth flat tubes firstly increase and then decrease, so that the plurality of six tube sections of the plurality of fourth flat tubes form a triangle structure or a trapezoid structure fitting the installation region.

In some embodiments, the fourth flat tube is of an integrally formed structure; a connection between the fourth tube section and the fifth tube section is an arc-shaped bent transition structure; or a connection between the fifth tube section and the sixth tube section is an arc-shaped bent transition structure.

In some embodiments, the second heat exchange portion includes a third heat exchange flat tube, the third heat exchange flat tube includes a plurality of bent tube sections connected in sequence, and heights of the plurality of bent tube sections connected in sequence gradually increase first and then gradually decrease, so that edges of the plurality of bent tube sections connected in sequence enclose to form a triangular structure fitting an installation region between the first heat exchange assembly and the second heat exchange assembly.

In some embodiments, there are a plurality of third heat exchange flat tubes, and the plurality of third heat exchange flat tubes are disposed at intervals in a height direction.

In some embodiments, inlet ends of the plurality of third heat exchange flat tubes are connected, and outlet ends of the plurality of third heat exchange flat tubes are connected.

In some embodiments, the second heat exchange portion includes a plurality of third heat exchange flat tubes, the plurality of third heat exchange flat tubes are disposed at intervals in an extension direction from the first heat exchange assembly to the second heat exchange assembly, each of the plurality of third heat exchange flat tubes includes a plurality of bent tube sections connected in sequence, and heights of the plurality of bent tube sections of the plurality of third heat exchange flat tubes gradually increase first and then gradually decrease, so that edges of the plurality of third heat exchange flat tubes enclose to form a triangular structure fitting an installation region between the first heat exchange assembly and the second heat exchange assembly.

In some embodiments, inlet ends of the plurality of third heat exchange flat tubes are connected, and outlet ends of the plurality of third heat exchange flat tubes are connected.

In some embodiments, the second heat exchange portion further includes: an inlet connecting tube, the inlet connecting tube extending in the extension direction from the first heat exchange assembly to the second heat exchange assembly, the inlet ends of the plurality of third heat exchange flat tubes being connected with the inlet connecting tube; or an outlet connecting tube, the outlet connecting tube extending in the extension direction from the first heat exchange assembly to the second heat exchange assembly, and the outlet ends of the plurality of third heat exchange flat tubes being connected with the outlet connecting tube.

In some embodiments, the second heat exchange portion is a bent flat tube structure, and the bent flat tube structure has a heat exchange inlet portion, a heat exchange outlet portion, and a bent heat exchange flow path structure communicating with both the heat exchange inlet portion and the heat exchange outlet portion; an edge of the bent flat tube structure encloses to form a triangle structure or a trapezoid structure.

In some embodiments, the bent flat tube structure includes: a fifth flat tube, the fifth flat tube including a plurality of fifth heat exchange tube sections disposed apart in a horizontal direction and being in communication with each other, the plurality of fifth heat exchange tube sections extending in a vertical direction.

In some embodiments, heights of the plurality of fifth heat exchange tube sections increase first and then decrease, one end of the fifth flat tube forms the heat exchange inlet portion, and an other end of the fifth flat tube forms the heat exchange outlet portion.

In some embodiments, there are a plurality of fifth flat tubes, the plurality of fifth flat tubes being disposed at intervals in a horizontal direction, the heat exchange inlet portion includes a plurality of first heat exchange inlets of the plurality of fifth flat tubes, the heat exchange outlet portion includes a plurality of first heat exchange outlets of the plurality of fifth flat tubes, heights of the plurality of fifth heat exchange tube sections of the plurality of fifth flat tubes increase first and then decrease.

In some embodiments, the plurality of first heat exchange inlets are disposed at intervals, and the plurality of first heat exchange outlets are disposed at intervals; the heat exchanger further includes: a first connecting pipeline, the plurality of first heat exchange inlets being connected with the first connecting pipeline, and the first connecting tube extending in a direction in which the plurality of first heat exchange inlets are disposed at intervals; or a second connecting pipeline, the plurality of first heat exchange outlets being connected with the second connecting pipeline, and the second connecting pipeline extending in a direction in which the plurality of first heat exchange outlets are disposed at intervals.

In some embodiments, heights of the plurality of fifth heat exchange tube sections of the fifth flat tube increase first and then decrease, there are a plurality of fifth flat tubes, and the plurality of the fifth flat tubes are disposed at intervals in the vertical direction.

In some embodiments, the heights of the plurality of fifth heat exchange tube sections of the fifth flat tube increase first and then decrease, and the bent flat tube structure further includes: a sixth flat tube, the sixth flat tube including a plurality of sixth heat exchange tube sections disposed apart in the horizontal direction and communicating with each other, each of the plurality of sixth heat exchange tube sections extending in the vertical direction, the plurality of sixth heat exchange tube sections having a same height, and the plurality of fifth heat exchange tube sections being installed above the plurality of sixth heat exchange tube sections.

In some embodiments, the bent flat tube structure includes: a plurality of first inclined sections and a plurality of second inclined sections, the plurality of first inclined sections and the plurality of second inclined sections being disposed in a one-to-one correspondingly manner, each of the plurality of first inclined sections is disposed corresponding to a corresponding second inclined section of the plurality of second inclined sections, so as to be spliced to form a triangular structure.

In some embodiments, the bent flat tube structure includes: a seventh flat tube and an eighth flat tube, the seventh flat tube including a plurality of third heat exchange tube sections disposed apart in a horizontal direction and communicating with each other, the eighth flat tube includes a plurality of fourth heat exchange tube sections disposed apart in the horizontal direction and communicating with each other, each of the plurality of third heat exchange tube sections includes a first inclined section, each of the plurality of fourth heat exchange tube sections includes a second inclined section, a plurality of first inclined sections of the plurality of third heat exchange tube sections and a plurality of second inclined sections of the plurality of fourth heat exchange tube sections are disposed in a one-to-one correspondingly manner, and each of the plurality of first inclined sections abuts against a corresponding second inclined section of the plurality of second inclined sections to enclose to form a triangular structure.

In some embodiments, the bent flat tube structure includes: a ninth flat tube, the ninth flat tube including a plurality of fifth heat exchange tube sections disposed apart in a vertical direction and communicating with each other, each of the plurality of fifth heat exchange tube sections including a third inclined section and a fourth inclined section connected with each other, and the third inclined section and the fourth inclined section enclosing to form a triangular structure.

By applying the technical solution of the present disclosure, the second heat exchange portion is disposed at the end portion of the first heat exchange portion, and the second heat exchange portion and the first heat exchange portion enclose to form an air duct, so that the second heat exchange portion can function as a wind shield and also perform effective heat exchange, thereby increasing the overall heat exchange area of the heat exchanger, improving the heat exchange performance, effectively using the area, and improving the compactness of the area layout. Therefore, by using the heat exchanger provided in the present disclosure, the technical problem in the art known to inventors of poor heat exchange performance of A-type heat exchangers is solved.

BRIEF DESCRIPTION OF THE DRAWINGS

As a constituent part of the disclosure, the drawings of the description are used to provide further understanding of the disclosure, and exemplary examples of the disclosure and their specification serve to explain the disclosure, and do not constitute improper limitation to the disclosure. In the accompanying drawings.

Figure 1:
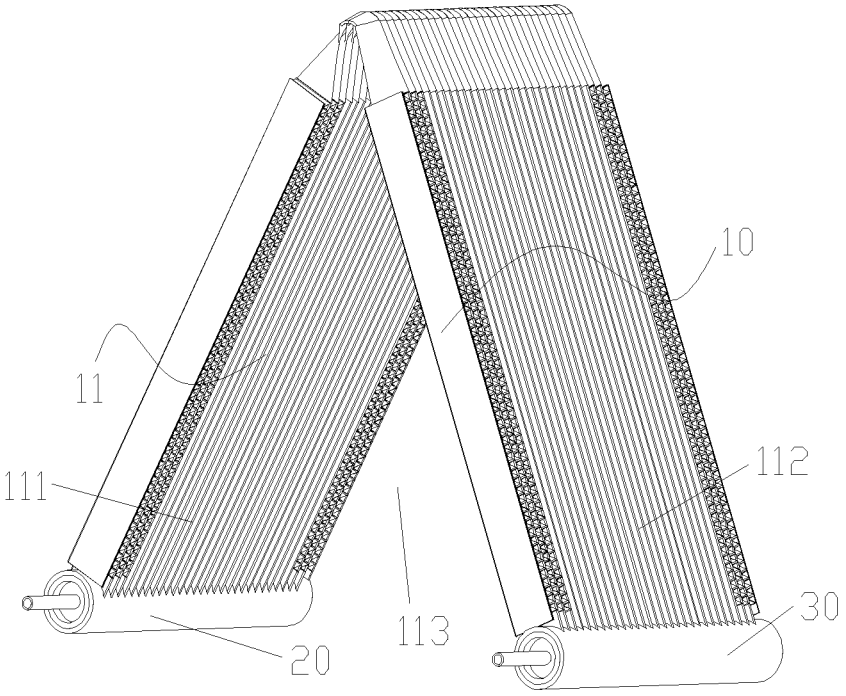
FIG. 1 illustrates a schematic structural diagram of a first heat exchange portion of a heat exchanger provided according to Embodiment 1 of the present disclosure.
Figure 2:
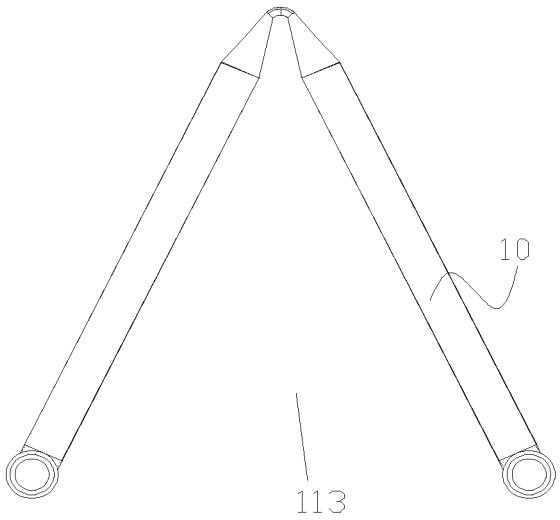
FIG. 2 illustrates a front view of a first heat exchange portion of a heat exchanger provided according to Embodiment 1 of the present disclosure.
Figure 3:
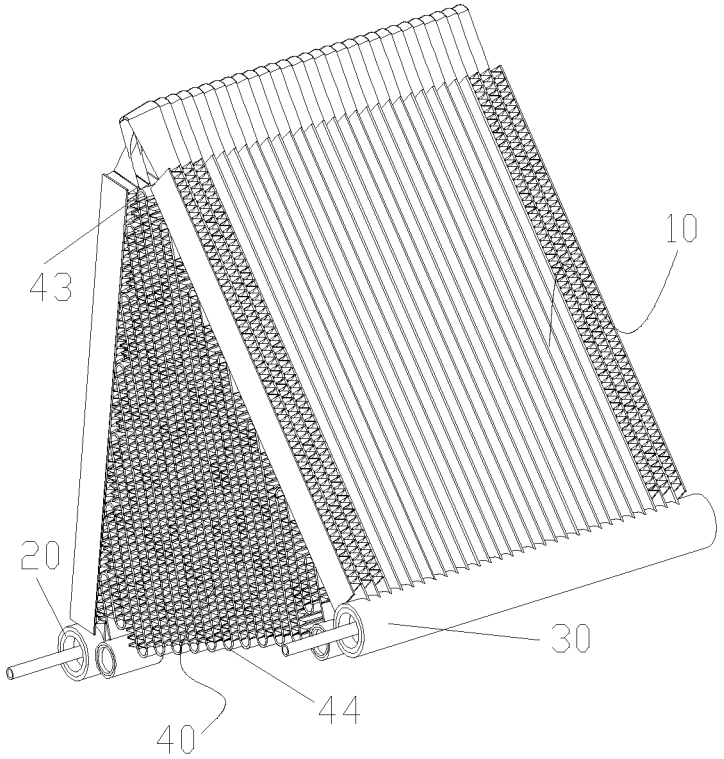
FIG. 3 illustrates a schematic structural diagram of a heat exchanger provided according to Embodiment 1 of the present disclosure.
Figure 4:
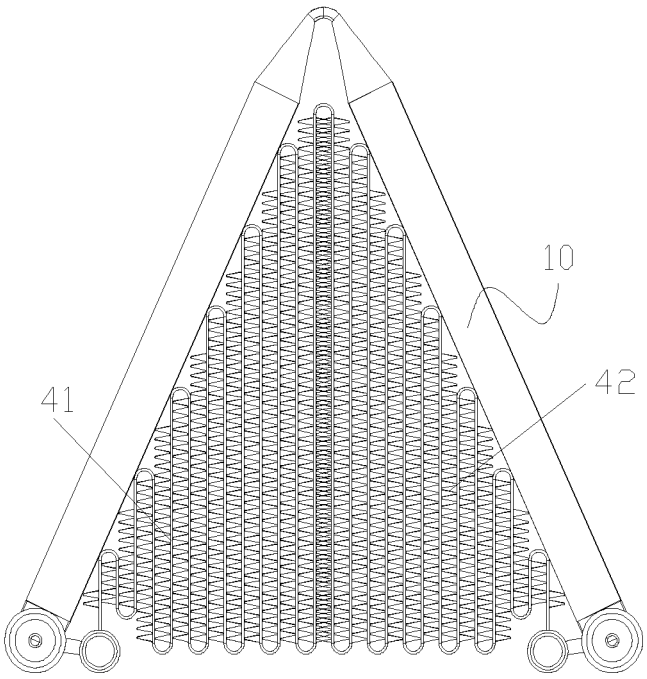
FIG. 4 illustrates a front view of a heat exchanger provided according to Embodiment 1 of the present disclosure.
Figure 5:
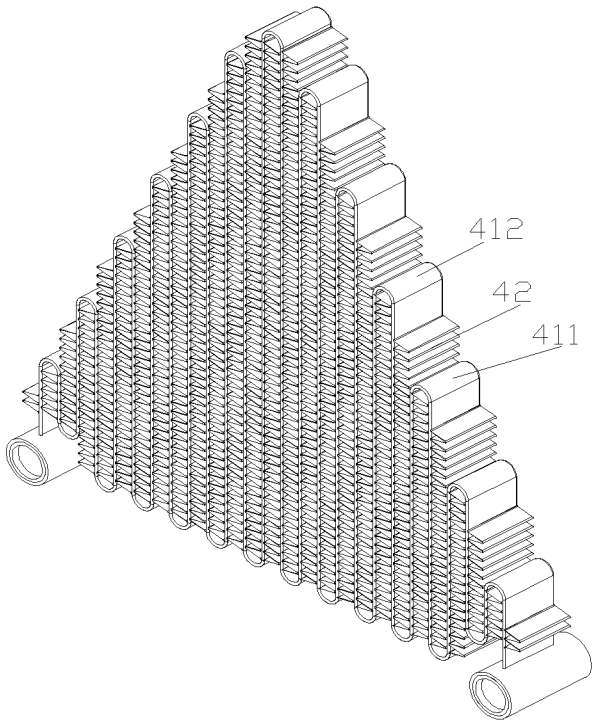
FIG. 5 illustrates a schematic structural diagram of a second heat exchange portion of a heat exchanger provided according to Embodiment 2 of the present disclosure.
Figure 6:
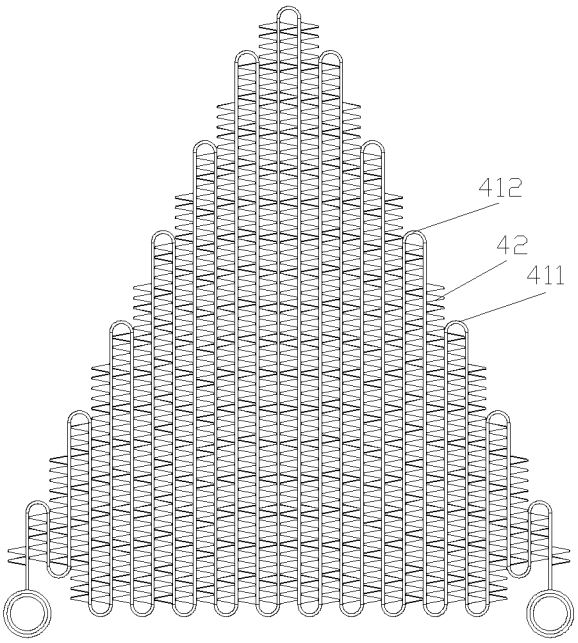
FIG. 6 illustrates a front view of a second heat exchange portion of a heat exchanger provided according to Embodiment 2 of the present disclosure.
Figure 7:
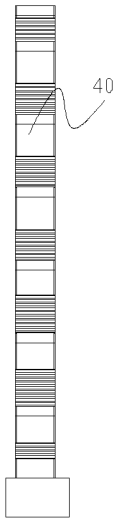
FIG. 7 illustrates a left view of a second heat exchange portion of a heat exchanger provided according to Embodiment 2 of the present disclosure.
Figure 8:
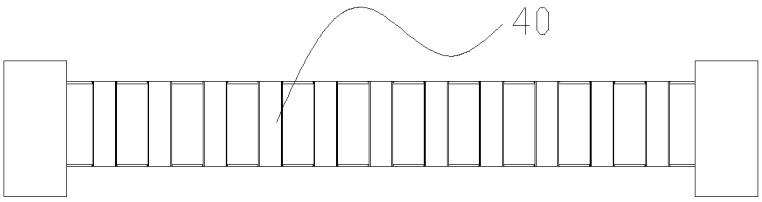
FIG. 8 illustrates a top view of a second heat exchange portion of a heat exchanger provided according to Embodiment 2 of the present disclosure.

The accompanying drawings include the following reference numerals:

10. first heat exchange portion; 11. first flat tube; 111. first heat exchange tube section; 112. second heat exchange tube section; 113. installation region; 12. first fin; 13. first heat exchange assembly; 131. first heat exchange flat tube; 14. second heat exchange assembly; 141. second heat exchange flat tube;

20. first manifold; 30. second manifold;

40. second heat exchange portion; 41. second flat tube; 411. first bent tube section; 412. second bent tube section; 42. second fin; 43. top end; 44. bottom end; 45. heat exchange structure; 46. third flat tube; 461. first tube section; 462. second tube section; 463. third tube section; 47. fourth flat tube; 471. fourth tube section; 472. fifth tube section; 473. sixth tube section; 48. third heat exchange flat tube; 491. inlet connecting tube; 492. outlet connecting tube; 4100. third manifold; 4110. fifth flat tube; 4111. fifth heat exchange tube section; 4120. sixth flat tube; 4121. sixth heat exchange tube section; 4130. seventh flat tube; 4131. first inclined section; 4132. first vertical section; 4140. eighth flat tube; 4141. second inclined section; 4142. second vertical section; 4150. ninth flat tube; 4151. third inclined section; 4152. fourth inclined section; 4153. third vertical section; 4154. fourth vertical section; 4160. tenth flat tube;

51. first connecting tube; 52. second connecting tube; 53. third connecting tube; 54. fourth connecting tube; 55. fifth connecting tube; 56. sixth connecting tube;

61. first tube; 62. second tube;

71. first collecting tube; 72. second collecting tube;

80. intermediate manifold; 81. inlet tube section; 82. outlet tube section; 83. partition plate;

90. connecting pipe;

101. inlet connecting pipe; 102. outlet connecting pipe;

110. joint pipe;

120. first connecting pipeline; 130. second connecting pipeline; 140. third connecting pipeline; 150. fourth connecting pipeline; 160. fifth connecting pipeline; 170. sixth connecting pipeline.

DETAILED DESCRIPTION OF THE EMBODIMENTS

It is to be noted that the embodiments and features in the embodiments of the disclosure can be combined with each other without conflict. The disclosure will be described in detail below with reference to the accompanying drawings and the embodiments.

As shown in FIG. 1 to FIG. 4, Embodiment 1 of the present disclosure provides a heat exchanger, and the heat exchanger includes a first heat exchange portion 10, a first manifold 20, a second manifold 30, and a second heat exchange portion 40. The first heat exchange portion 10 includes a plurality of first flat tubes 11 disposed at intervals, each of the plurality of first flat tubes 11 includes a first heat exchange tube section 111 and a second heat exchange tube section 112 connected with each other, and the first heat exchange tube section 111 and the second heat exchange tube section 112 are disposed at a preset angle. A plurality of first heat exchange tube sections 111 of the plurality of first flat tubes 11 are all connected with the first manifold 20, and a plurality of second heat exchange tube sections 112 of the plurality of first flat tubes 11 are connected with the second manifold 30, so as to form an A-type heat exchanger structure. The second heat exchange portion 40 is disposed at an end portion of the first heat exchange portion 10, and the first heat exchange portion 10 and the second heat exchange portion 40 enclose to form an air duct. It should be noted that, the air duct herein refers to a main circulation passage for air to enter the heat exchanger.

According to the heat exchanger provided in the present embodiment, the first heat exchange portion 10 and the second heat exchange portion 40 enclose to form the air duct. In this way, not only can the second heat exchange portion 40 effectively serve as a wind shield, but also both the first heat exchange portion 10 and the second heat exchange portion 40 can exchange heat, thereby increasing the overall heat exchange area, improving the heat exchange performance, effectively utilizing area, and improving the compactness of the area layout. Therefore, by using the heat exchanger provided in the present embodiment, the technical problem in the art known to inventors of poor heat exchange performance of A-type heat exchangers is solved.

In some embodiments, an installation region 113 is provided between the first heat exchange tube section 111 and the second heat exchange tube section 112, and the second heat exchange portion 40 is disposed in the installation region 113. The first heat exchange tube section 111 and the second heat exchange tube section 112 are disposed at a preset angle, so as to facilitate discharge of condensed water when the heat exchanger is working.

According to the heat exchanger provided in some embodiments, the second heat exchange portion 40 is disposed at an end portion of the first heat exchange portion 10, and the second heat exchange portion 40 is disposed in the installation region 113 between the first heat exchange tube sections 111 and the second heat exchange tube sections 112, in this way, the second heat exchange portion 40 can also perform effective heat exchange while serving as a wind shield, thereby increasing the overall heat exchange area of the heat exchanger, improving the heat exchange performance, effectively using the area, and improving the compactness of the area layout. Therefore, by using the heat exchanger provided in some embodiments, the technical problem in the art known to inventors of poor heat exchange performance of A-type heat exchangers is solved.

In some embodiments, the installation region 113 is a triangular region, the second heat exchange portion 40 is a triangular or trapezoidal structure fitting the installation region 113, and the second heat exchange portion 40 is at least partially fitted to the first heat exchange tube sections 111 and the second heat exchange tube sections 112. By using such a structural arrangement, the wind shield performance can be improved, the stability of the arrangement of the second heat exchange portion 40 can be improved, the structural arrangement is optimized, and the compactness of the structural layout is improved. In order to make full use of the heat exchange area of the heat exchanger and function as a wind shield, in some embodiments, the overall dimension of the second heat exchange portion 40 can be completely consistent with the spatial dimension between the first heat exchange tube section 111 and the second heat exchange tube section 112 of the first heat exchange portion 10, so as to make full use of the area and function as a wind shield.

In some embodiments, an angle between the first heat exchange tube section 111 and the second heat exchange tube section 112 forms an apex angle of the triangular region, and the apex angle of the triangular region is the same as an apex angle of the triangular structure. Such a structure arrangement can facilitate the second heat exchange portion 40 in better filling in the installation region 113, so as to better achieve a blocking effect and effectively function as a wind shield.

In some embodiments, the second heat exchange portion 40 includes a second flat tube 41, the second flat tube 41 includes a plurality of bent tube sections connected in sequence, and heights of the plurality of bent tube sections connected in sequence gradually increase first and then gradually decrease, so that edges of the plurality of bent tube sections connected in sequence enclose to form the triangular structure. By means of such a structure arrangement, the structure is simple, the triangular structure is formed conveniently, and the production and manufacture are facilitated.

As shown in FIGS. 5 to 8, Embodiment 2 of the present disclosure provides a heat exchanger, and the heat exchanger in the present embodiment differs from the heat exchanger in Embodiment 1 lies in that the specific structure of the second heat exchange portion 40 is different. In the present embodiment, the second heat exchange portion 40 includes a second flat tube 41 and second fins 42, the second flat tube 41 includes a plurality of bent tube sections connected in sequence, and heights of the plurality of bent tube sections connected in sequence gradually increase first and then gradually decrease, there are a plurality of second fins 42, and the plurality of second fins 42 are installed in a bending gap of each of the plurality of bent tube sections connected in sequence and between two adjacent bent tube sections of the plurality of bent tube sections connected in sequence; wherein the two adjacent bent tube sections of the plurality of bent tube sections connected in sequence include a first bent tube section 411 and a second bent tube section 412, a height of a first bent tube section 411, a height of a second fin 42 of the plurality of second fins 42 between the first bent tube section 411 and the second bent tube section 412, and a height of the second bent tube section 412 gradually increase or decrease in sequence, so that an edge of the second flat tube 41 and edges of the plurality of second fins 42 enclose to form the triangular structure. In some embodiments, the first bent tube section 411 and the second bent tube section 412 are any two adjacent bent tube sections of the plurality of bent tube sections. By means of such a structure arrangement, the structure layout of the second flat tube 41 and the second fin 42 can be optimized, the compactness of the structure arrangement is improved, a triangular structure is formed conveniently, and the overall area layout is optimized.

In some embodiments, each of the plurality of bent tube sections is a U-shaped tube structure, an opening end of the U-shaped tube structure is disposed at the bottom, and two adjacent U-shaped tube structures are connected by means of an arc-shaped tube. In some embodiments, the second flat tube 41 is an integrally formed structure, so as to facilitate production and manufacture.

In some embodiments, the second heat exchange portion 40 can also be a multi-path structure, that is, the second heat exchange portion 40 has a plurality of inlets and a plurality of outlets, and the plurality of inlets and the plurality of outlets are disposed in a one-to-one correspondingly manner.

Figure 9:
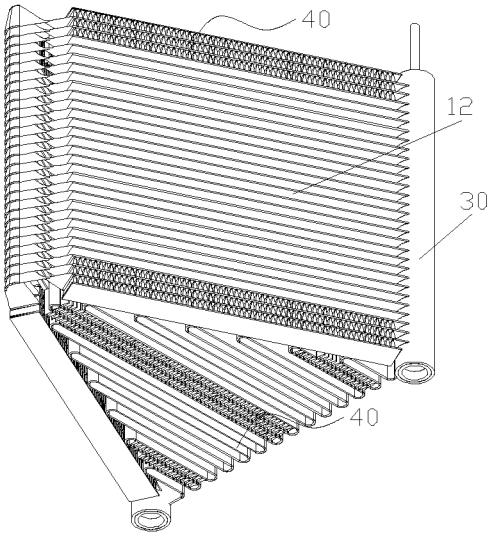
FIG. 9 illustrates a schematic structural diagram of a heat exchanger provided according to Embodiment 3 of the present disclosure.
Figure 10:
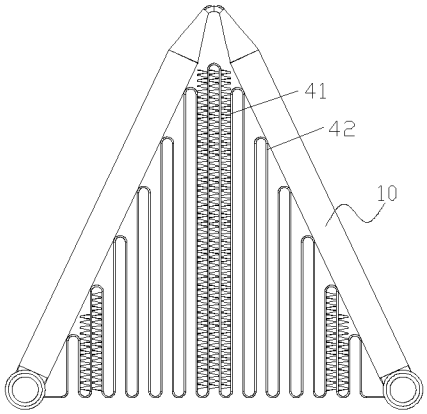
FIG. 10 illustrates a front view of a heat exchanger provided according to Embodiment 3 of the present disclosure.
Figure 11:
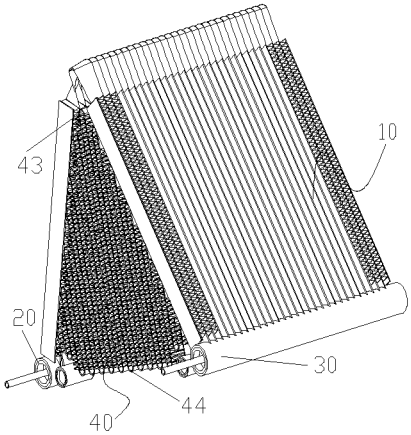
FIG. 11 illustrates a schematic structural diagram of a heat exchanger provided according to Embodiment 5 of the present disclosure.
Figure 12:
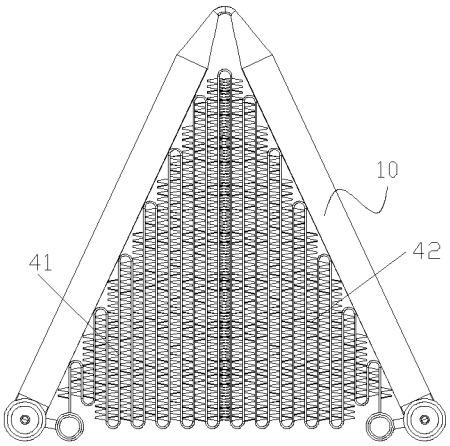
FIG. 12 illustrates a front view of a heat exchanger provided according to Embodiment 5 of the present disclosure.
Figure 13:
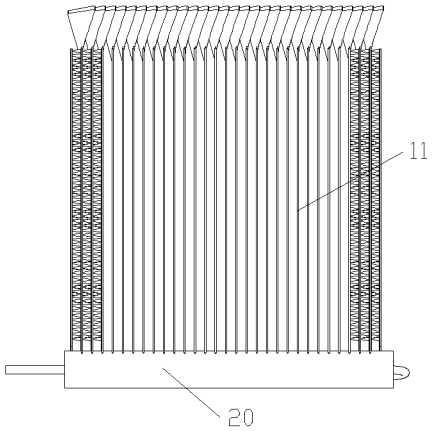
FIG. 13 illustrates a left view of a heat exchanger provided according to Embodiment 5 of the present disclosure.
Figure 14:
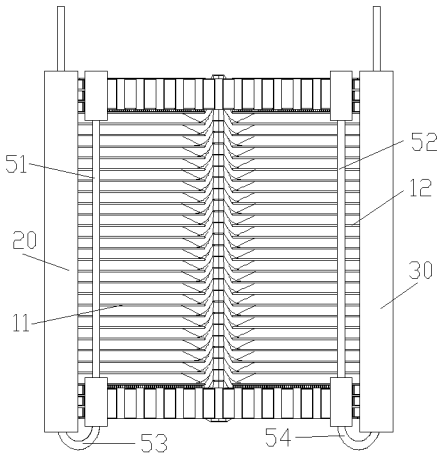
FIG. 14 illustrates a top view of a heat exchanger provided according to Embodiment 5 of the present disclosure.
Figure 15:
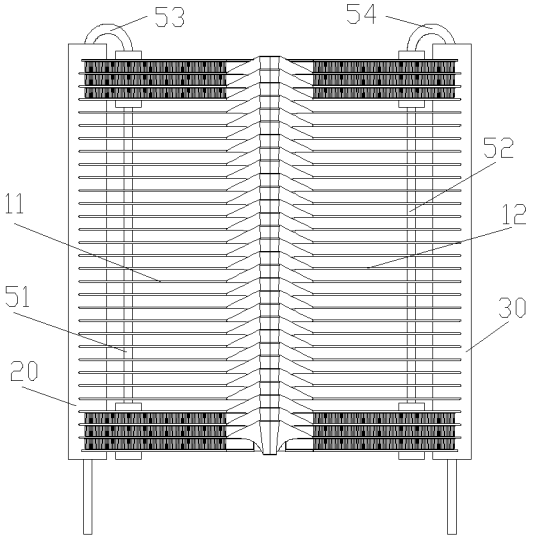
FIG. 15 illustrates a bottom view of a heat exchanger provided according to Embodiment 5 of the present disclosure.
Figure 16:
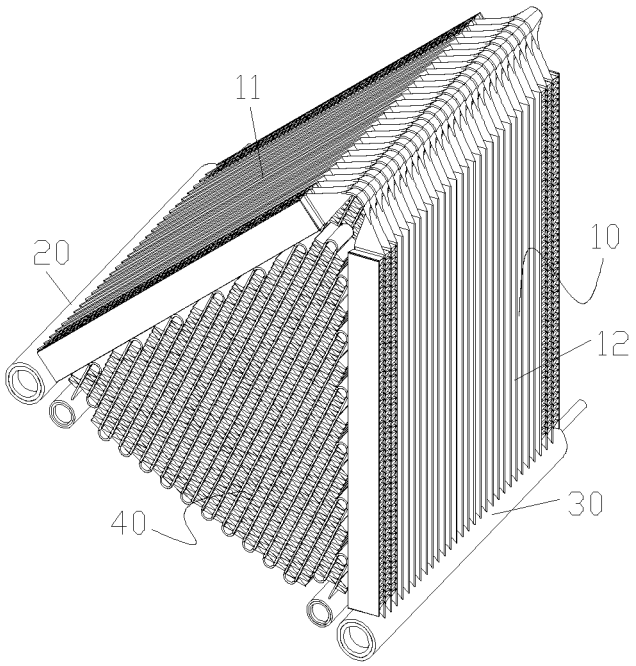
FIG. 16 illustrates a schematic structural diagram of a heat exchanger provided according to Embodiment 6 of the present disclosure.
Figure 17:
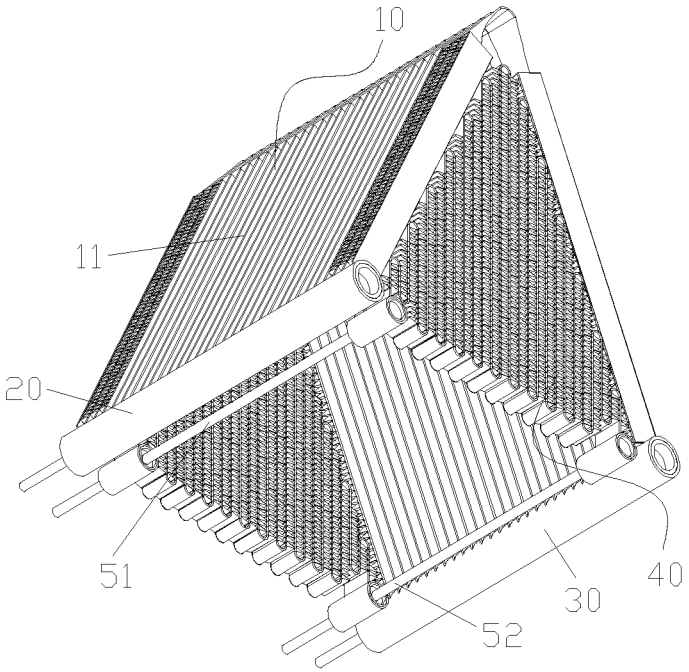
FIG. 17 illustrates a schematic structural diagram from another angle of a heat exchanger provided according to Embodiment 6 of the present disclosure.
Figure 18:
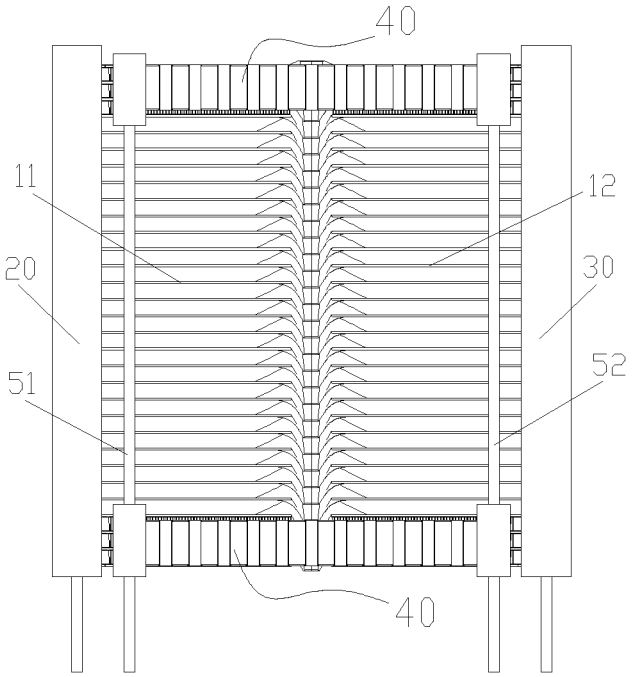
FIG. 18 illustrates a top view of a heat exchanger provided according to Embodiment 6 of the present disclosure.
Figure 19:
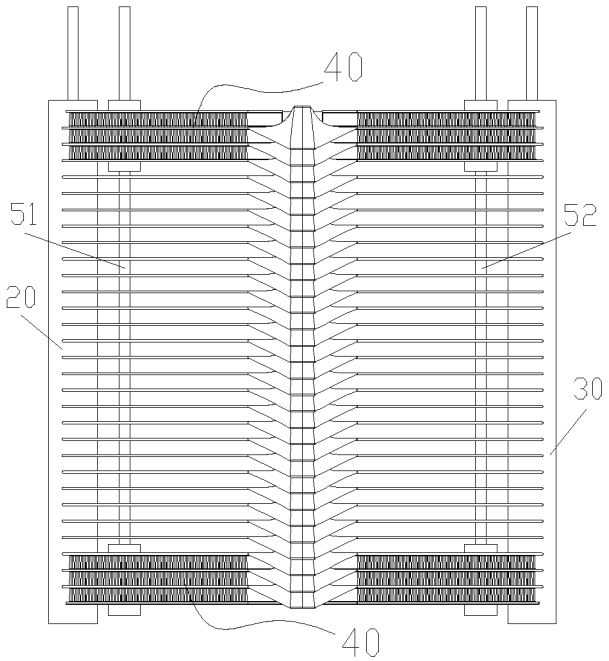
FIG. 19 illustrates a bottom view of a heat exchanger provided according to Embodiment 6 of the present disclosure.
Figure 20:
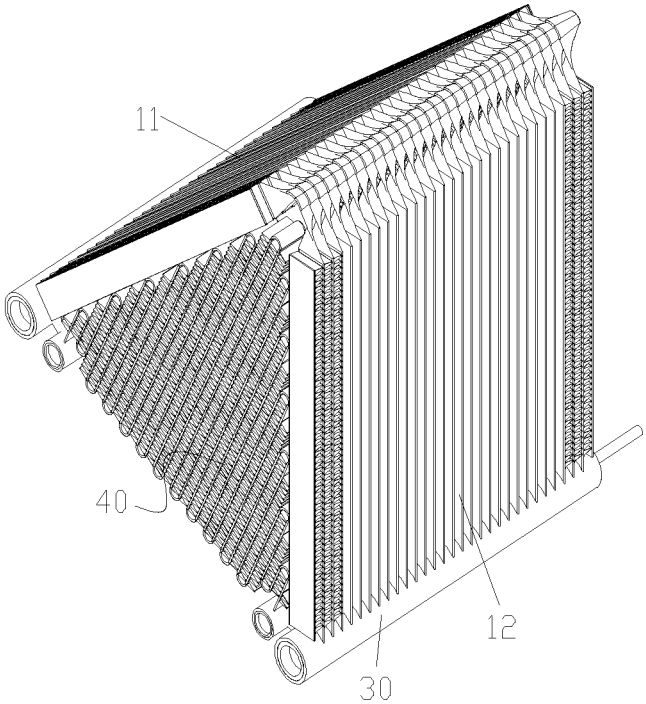
FIG. 20 illustrates a schematic structural diagram of a heat exchanger provided according to Embodiment 7 of the present disclosure.
Figure 21:
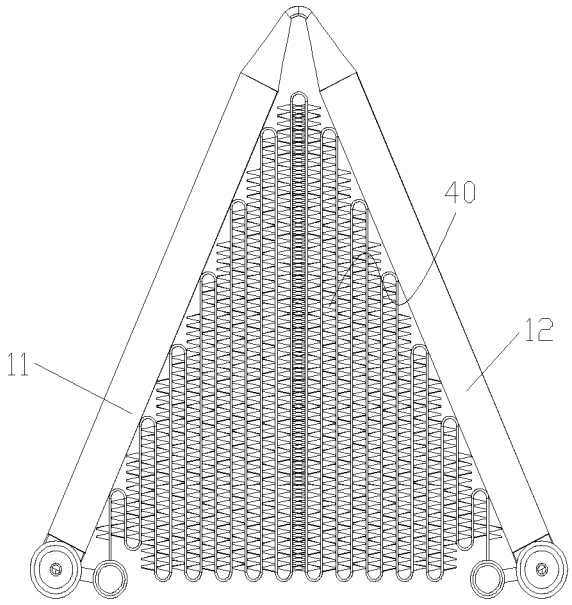
FIG. 21 illustrates a front view of a heat exchanger provided according to Embodiment 7 of the present disclosure.
Figure 22:
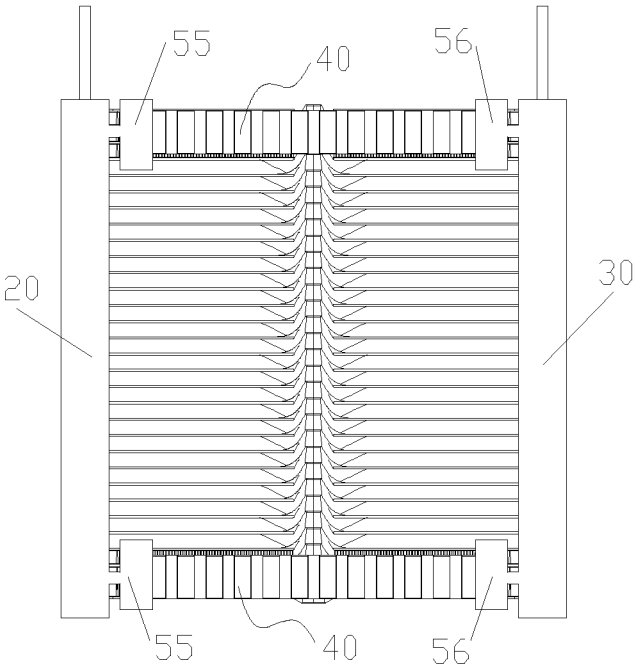
FIG. 22 illustrates a top view of a heat exchanger provided according to Embodiment 7 of the present disclosure.
Figure 23:
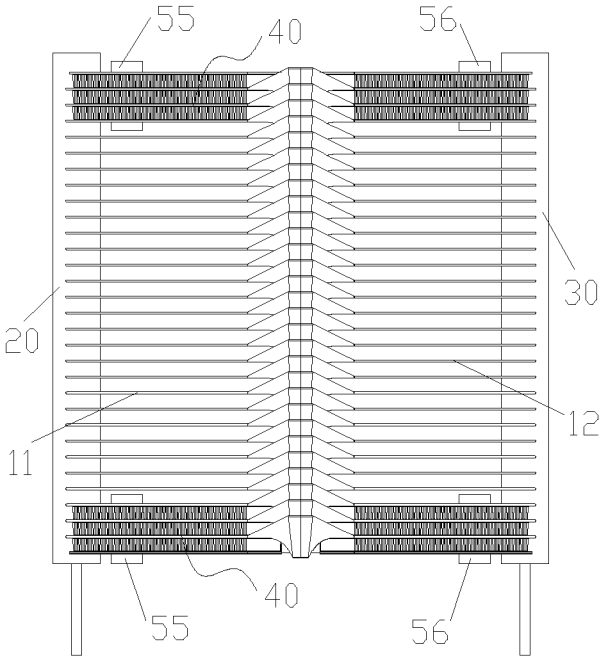
FIG. 23 illustrates a bottom view of a heat exchanger provided according to Embodiment 7 of the present disclosure.

As shown in FIGS. 9 and 10, Embodiment 3 of the present disclosure provides a heat exchanger, and the heat exchanger in Embodiment 3 is a solution for improving a connection relationship of the second heat exchange portion 40 on the basis of Embodiment 1 and Embodiment 2. In the present embodiment, an inlet end of the second heat exchange portion 40 is in communication with the first manifold 20, and an outlet end of the second heat exchange portion 40 is in communication with the second manifold 30. With such a structure arrangement, the first manifold 20 can supply a heat exchange medium to the first heat exchange portion 10 and the second heat exchange portion 40, and the second manifold 30 can collect the heat exchange medium flowing out through the first heat exchange portion 10 and the second heat exchange portion 40. There is no need to additionally add a manifold structure, thereby optimizing the layout of the structure and the arrangement of the connection.

In some embodiments, the second heat exchange portion 40 includes a second flat tube 41. A first insertion slot is arranged on the first manifold 20, the first insertion slot extends in an axial direction of the first manifold 20, and one end of the second flat tube 41 is inserted into the first insertion slot; or a second insertion slot is arranged on the second manifold 30, the second insertion slot extends in an axial direction of the second manifold 30, and an other end of the second flat tube 41 is inserted into the second insertion slot. Alternatively, a first insertion slot is arranged on the first manifold 20, the first insertion slot extends in the axial direction of the first manifold 20, and one end of the second flat tube 41 is inserted into the first insertion slot; and a second insertion slot is arranged on the second manifold 30, the second insertion slot extends in the axial direction of the second manifold 30, and the other end of the second flat tube 41 is inserted into the second insertion slot.

In the present embodiment, a first insertion slot is arranged on the first manifold 20, the first insertion slot extends in the axial direction of the first manifold 20, and one end of the second flat tube 41 is inserted into the first insertion slot; and a second insertion slot is arranged on the second manifold 30, the second insertion slot extends in the axial direction of the second manifold 30, and the other end of the second flat tube 41 is inserted into the second insertion slot. By means of such a structural arrangement, one end of the second flat tube 41 can be conveniently inserted into the first insertion slot, and the other end of the second flat tube 41 can be conveniently inserted into the second insertion slot, thereby facilitating installation and removal, and facilitating direct connection. In some embodiments, the first insertion slot and the second insertion slot are both disposed on the side wall of the first manifold 20.

In the present embodiment, the second heat exchange portion 40 includes a second flat tube 41 and second fins 42, the second flat tube 41 includes a plurality of bent tube sections connected in sequence, the second fins 42 can be disposed in the bent tube sections, or the second fins 42 can be disposed between two adjacent bent tube sections of the plurality of bent tube sections connected in sequence, and a number of the second fins 42 in the present embodiment is smaller than that in Embodiment 2, so that the installation and manufacture are facilitated.

Embodiment 4 of the present disclosure provides a heat exchanger, in the present embodiment, the inlet end of the second heat exchange portion 40 is also in communication with the first manifold 20, and the outlet end of the second heat exchange portion 40 is also in communication with the second manifold 30. The heat exchanger in the present embodiment mainly differs from the heat exchanger in Embodiment 3 in the connection manner between the inlet end of the second heat exchange portion 40 and the first manifold 20, and the connection manner between the outlet end of the second heat exchange portion 40 and the second manifold 30.

In the present embodiment, both the inlet end and the outlet end of the second heat exchange portion 40 are provided with connecting pipelines, so that the inlet end of the second heat exchange portion 40 is in communication with the first manifold 20 by means of the connecting pipeline, and the outlet end of the second heat exchange portion 40 is in communication with the second manifold 30 by means of the connecting pipeline. By means of such a connection manner, the connection is simple, and the operation is convenient.

In some embodiments, the second heat exchange portion includes a third manifold, a fourth manifold and a second flat tube 41, the second flat tube 41 is in communication with the third manifold and the fourth manifold respectively, and the third manifold and the fourth manifold are in communication with the first manifold 20 and the second manifold 30 respectively by means of connecting tubes.

In all the foregoing embodiments, there are at least two second heat exchange portions 40, the at least two second heat exchange portions 40 are disposed at intervals, one of the two second heat exchange portion 40 is disposed at one end of the first heat exchange portion 10, and the other of the two second heat exchange portion 40 is disposed at the other end of the first heat exchange portion 10. By means of such a structural arrangement, the heat exchange performance can be better improved, and the wind shield effect can be effectively achieved.

As shown in FIGS. 11 to 15, Embodiment 5 of the present disclosure provides a heat exchanger, and Embodiment 5 is an improvement made on the basis of all the foregoing embodiments. In the present embodiment, there are two second heat exchange portions 40, the two second heat exchange portions 40 are respectively disposed at two ends of the first heat exchange portion 10, inlet ends of the two second heat exchange portions 40 are connected by means of a first connecting tube 51, and outlet ends of the two second heat exchange portions 40 are connected by means of a second connecting tube 52. The heat exchanger further includes a third connecting tube 53 and a fourth connecting tube 54 that are disposed at intervals, the third connecting tube 53 and the fourth connecting tube 54 are both disposed on one of the two second heat exchange portions 40, the third connecting tube 53 is disposed between the one of the two second heat exchange portions 40 and the first manifold 20, and the fourth connecting tube 54 is disposed between the one of the two second heat exchange portions 40 and the second manifold 30. Such a structure arrangement can facilitate the heat exchange medium in the first manifold 20 sequentially flowing into the inlet ends of the two heat exchange portions, and facilitate the heat exchange medium flowing out of the outlet ends of the two heat exchange portions being collected by the second manifold 30, without adding an additional manifold structure, thereby reducing the number of parts and optimizing the structure layout.

As shown in FIGS. 16 to 19, Embodiment 6 of the present disclosure provides a heat exchanger, and Embodiment 6 is an improvement made on the basis of Embodiment 1 to Embodiment 4. In the present embodiment, there are two second heat exchange portions 40, the two second heat exchange portions 40 are respectively disposed at two ends of the first heat exchange portion 10, the inlet ends of the two second heat exchange portions 40 are connected by means of a first connecting tube 51, and the outlet ends of the two second heat exchange portions 40 are connected by means of a second connecting tube 52. The two second heat exchange portions 40 are both disposed to be independent of the first heat exchange portion 10, so that the two second heat exchange portions 40 and the first heat exchange portion 10 exchange heat independently. Such a structural arrangement facilitates independent heat exchange between the two communicated second heat exchange portions 40 and the first heat exchange portion 10, thereby preventing the heat exchange medium in the two communicated second heat exchange portions 40 from interfering with the heat exchange medium in the first heat exchange portion 10, so as to achieve heat exchange with different effects and realize different heat exchange requirements.

As shown in FIGS. 20 to 23, Embodiment 7 of the present disclosure provides a heat exchanger, and the heat exchanger in the present embodiment is improved on the basis of Embodiment 1 to Embodiment 4. In the present embodiment, there are two second heat exchange portions 40, and the two second heat exchange portions 40 are respectively disposed at two ends of the first heat exchange portion 10; the inlet ends of the two second heat exchange portions 40 are both connected with a side portion of the first manifold 20, and the outlet ends of the two second heat exchange portions 40 are connected with a side potion of the second manifold 30, that is, the length of the first manifold 20 and the length of the second manifold 30 are both greater than the gap between the two second heat change portions 40. A connection between an inlet end of one of the two second heat exchange portions 40 and the first manifold 20 and a connection between an inlet end of the other of the two second heat exchange portions 40 and the first manifold 20 are respectively disposed at two ends of the first heat exchange portion 10; and a connection between an outlet end of one of the two second heat exchange portions 40 and the second manifold 30 and a connection between an outlet end of the other of the two second heat exchange portions 40 and the second manifold 30 are respectively disposed at two ends of the first heat exchange portion 10. With such a structure arrangement, it is only required to connect the two second heat exchange portions 40 to the first manifold 20 and the second manifold 30 as close as possible, thereby facilitating the usage and operation. In the present embodiment, the heat exchanger further includes two fifth connecting tubes 55 and two sixth connecting tubes 56, the two fifth connecting tubes 55 are respectively disposed at connections between the inlet ends of the two second heat exchange portions 40 and the first manifold 20, and the two sixth connecting tubes 56 are respectively disposed at connections between the outlet ends of the two second heat exchange portions 40 and the second manifold 30.

Figure 24:
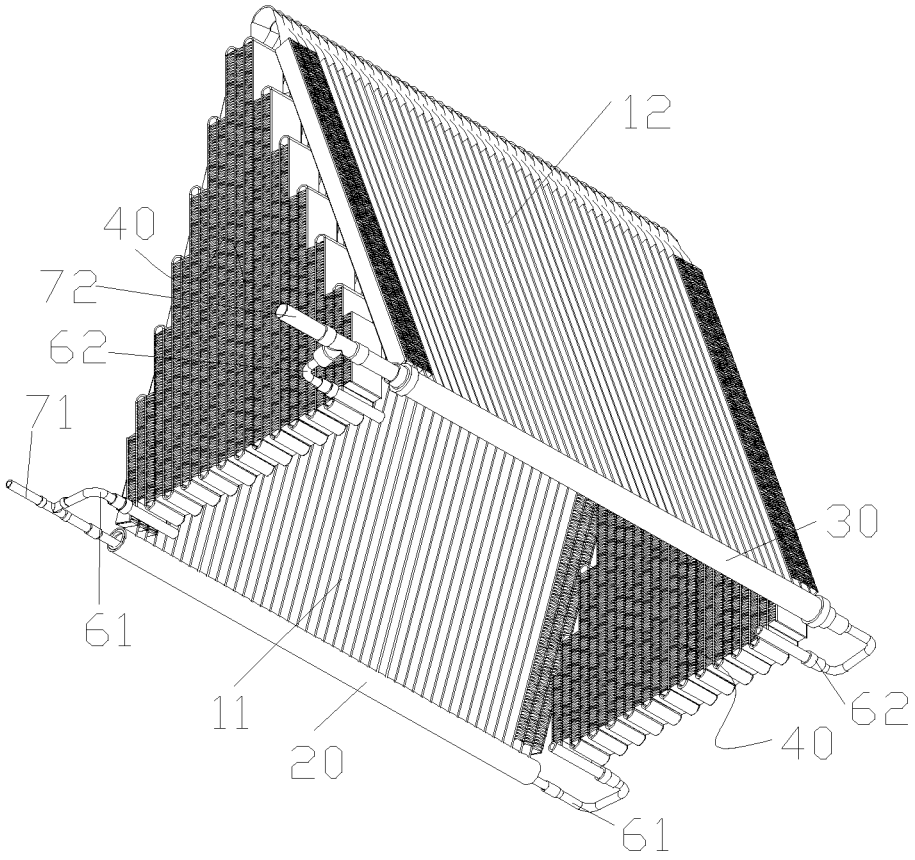
FIG. 24 illustrates a schematic structural diagram of a heat exchanger provided according to Embodiment 8 of the present disclosure.
Figure 25:
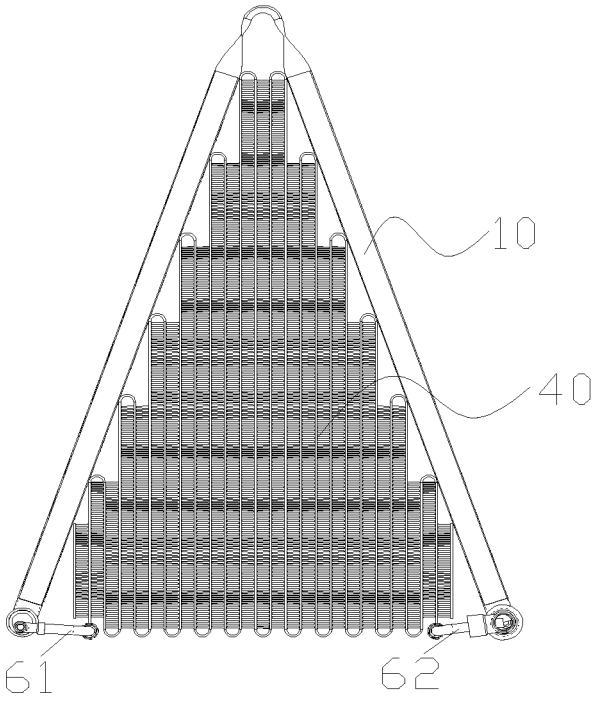
FIG. 25 illustrates a front view of a heat exchanger provided according to Embodiment 8 of the present disclosure.
Figure 26:
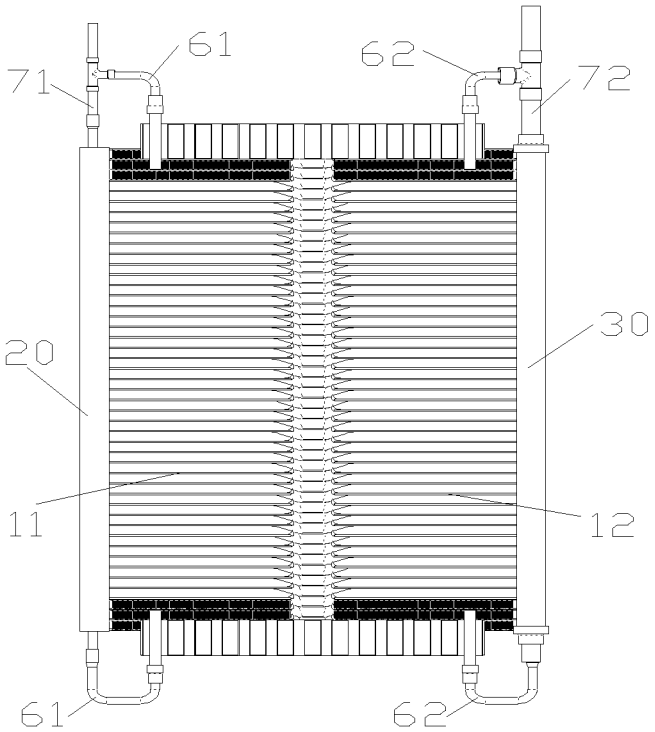
FIG. 26 illustrates a top view of a heat exchanger provided according to Embodiment 8 of the present disclosure.
Figure 27:
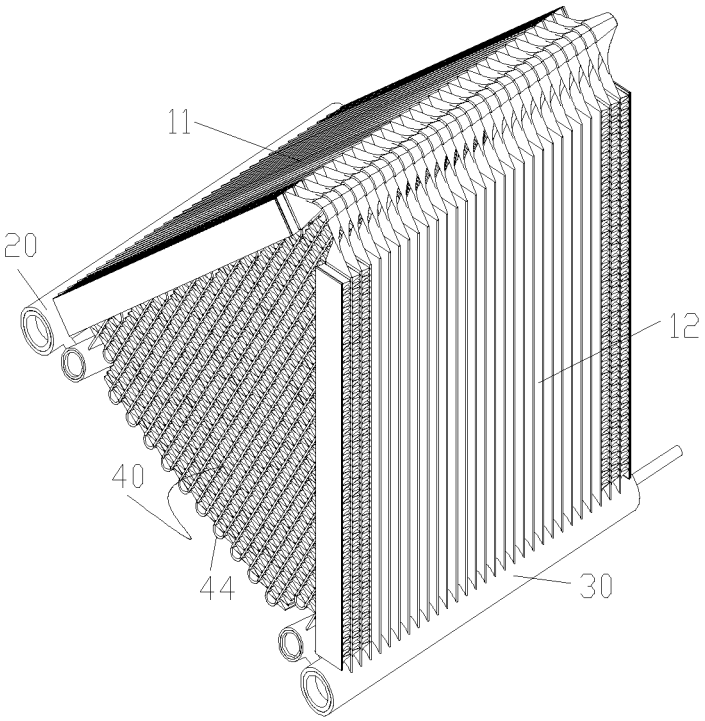
FIG. 27 illustrates a schematic structural diagram of a heat exchanger provided according to Embodiment 9 of the present disclosure.
Figure 28:
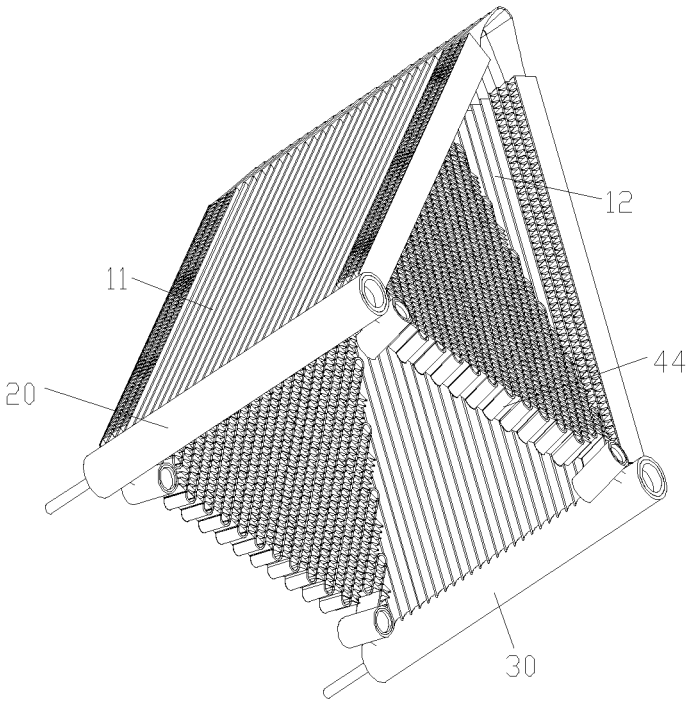
FIG. 28 illustrates a schematic structural diagram from another angle of a heat exchanger provided according to Embodiment 9 of the present disclosure.
Figure 29:
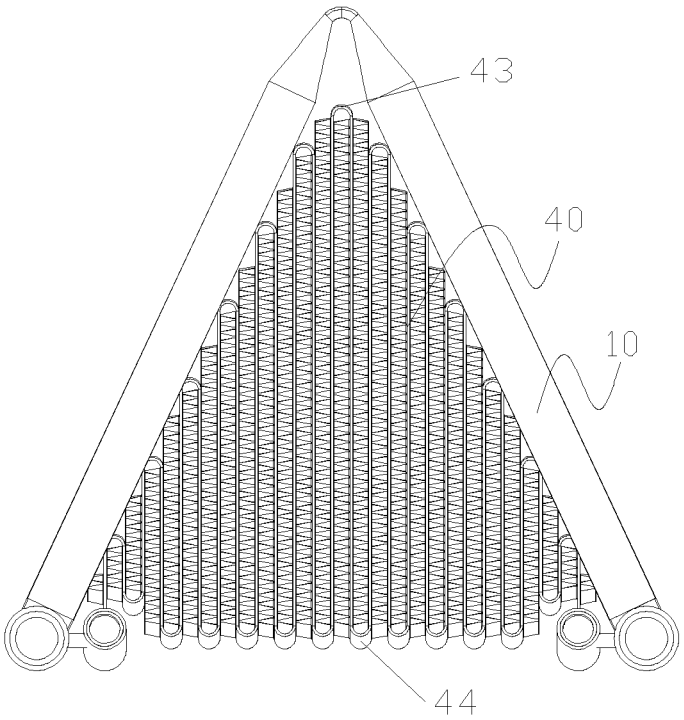
FIG. 29 illustrates a front view of a heat exchanger provided according to Embodiment 9 of the present disclosure.
Figure 30:
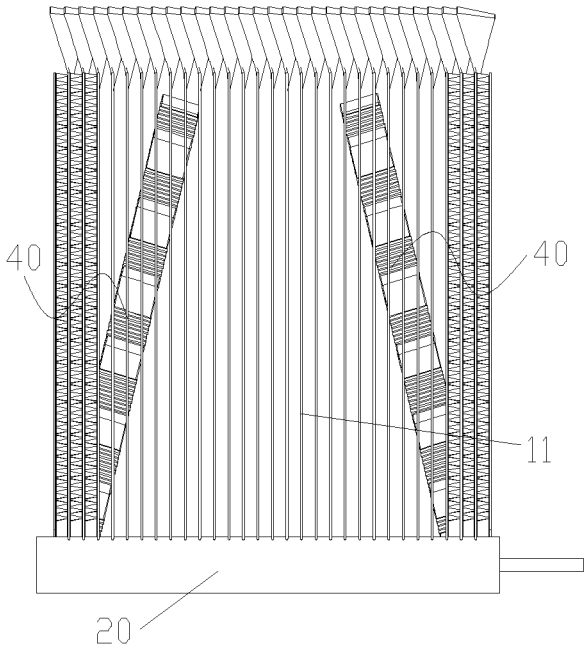
FIG. 30 illustrates a left view of a heat exchanger provided according to Embodiment 9 of the present disclosure.
Figure 31:
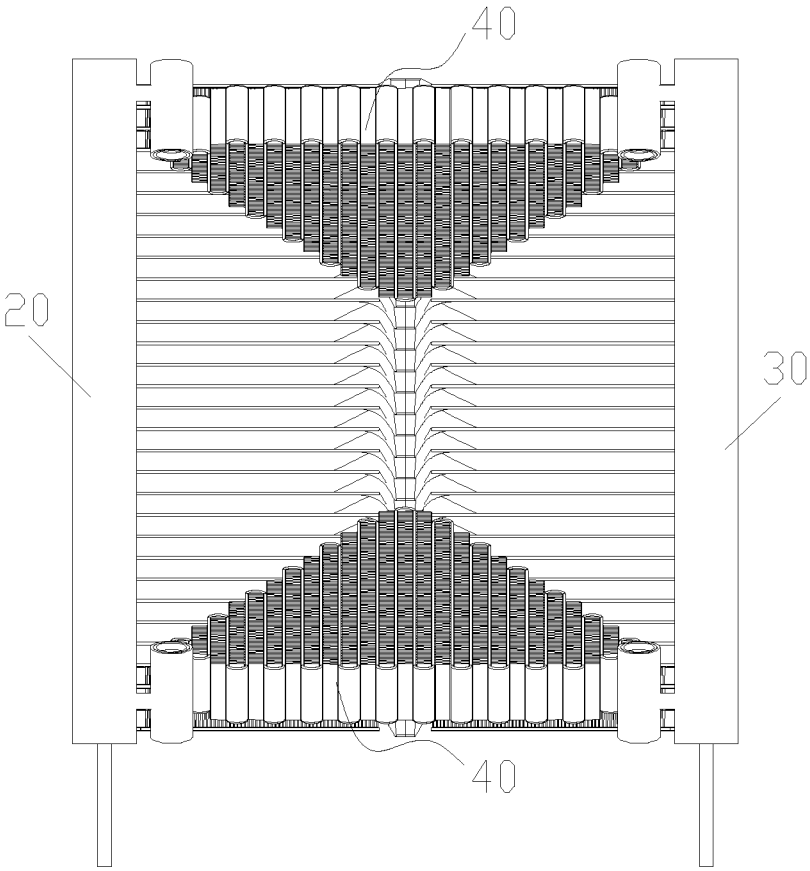
FIG. 31 illustrates a bottom view of a heat exchanger provided according to Embodiment 9 of the present disclosure.
Figure 32:
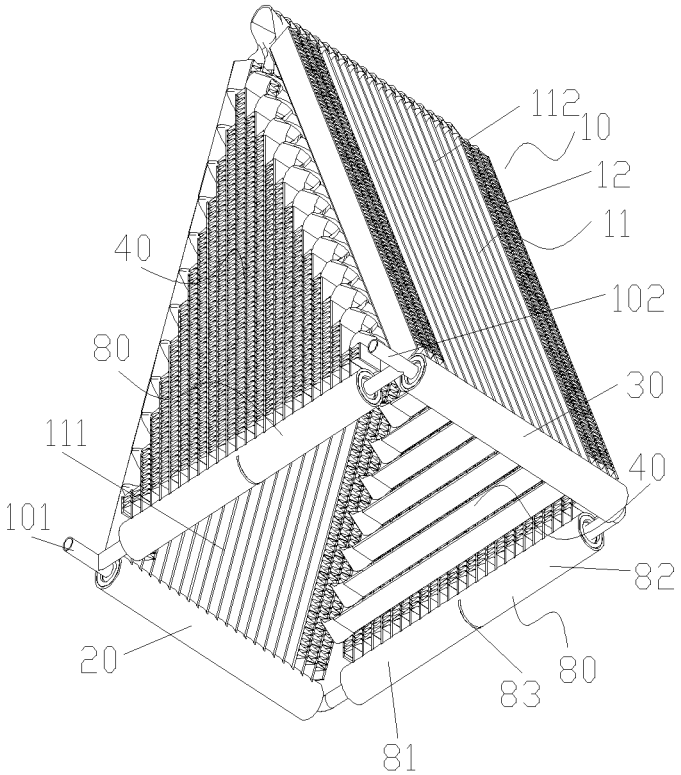
FIG. 32 illustrates a schematic structural diagram of a heat exchanger provided according to Embodiment 10 of the present disclosure.
Figure 33:
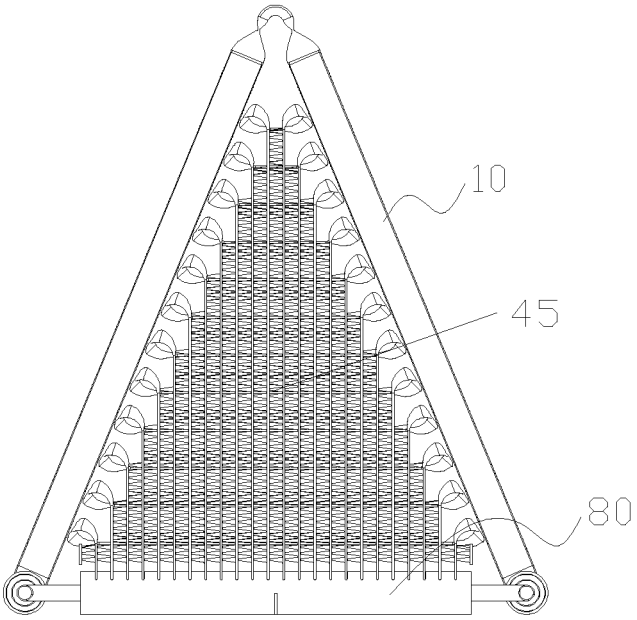
FIG. 33 illustrates a front view of a heat exchanger provided according to Embodiment 10 of the present disclosure.
Figure 34:
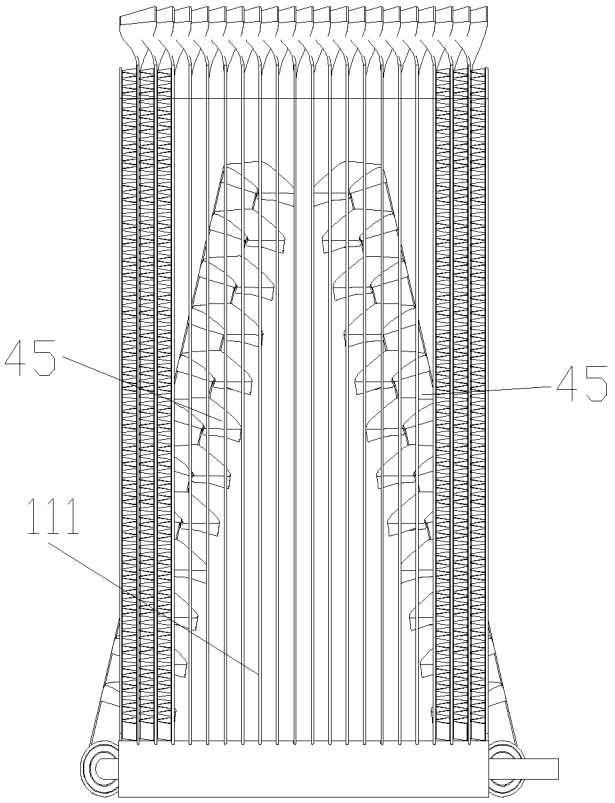
FIG. 34 illustrates a left view of a heat exchanger provided according to Embodiment 10 of the present disclosure.
Figure 35:
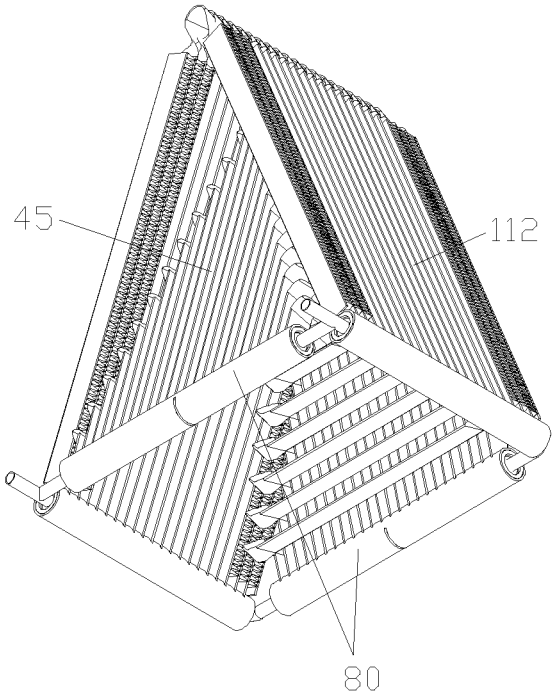
FIG. 35 illustrates a schematic structural diagram of a heat exchange structure disposed to be inclined in a heat exchanger provided according to Embodiment 10 of the present disclosure.
Figure 36:
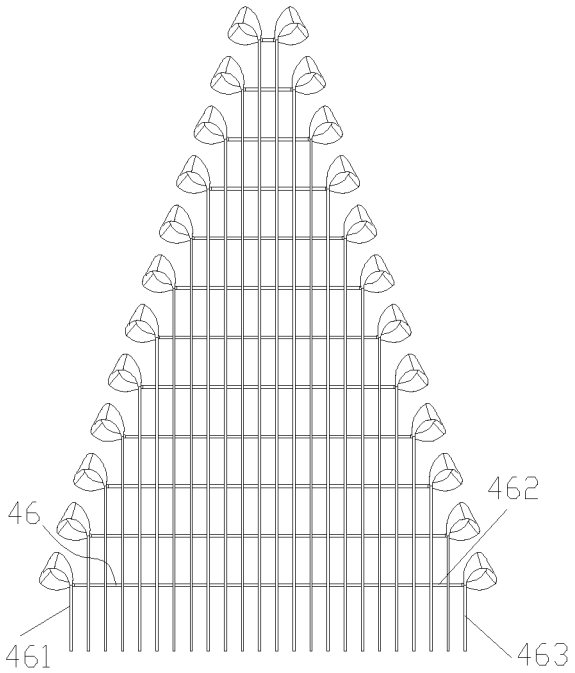
FIG. 36 illustrates a front view of a heat exchange structure according to Embodiment 10 of the present disclosure.
Figure 37:
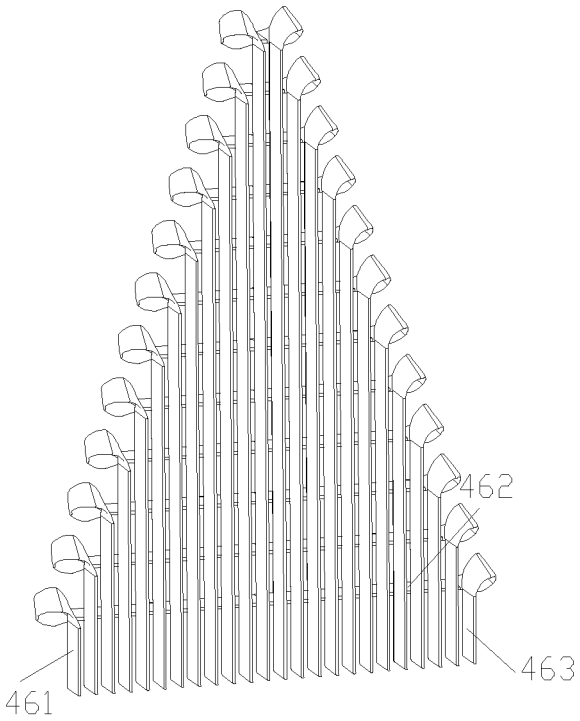
FIG. 37 illustrates a schematic structural diagram of a heat exchange structure according to Embodiment 10 of the present disclosure.

As shown in FIGS. 24 to 26, Embodiment 8 of the present disclosure provides a heat exchanger, the heat exchanger in the present embodiment is an improvement made on the basis of Embodiment 1 to Embodiment 4, there are two second heat exchange portions 40 in the present embodiment, and the two second heat exchange portions 40 are respectively disposed at two ends of the first heat exchange portion 10. The heat exchanger further includes two first tubes 61 and two second tubes 62, one end of one of the two connecting tubes 61 and one end of an other of the two first tubes 61 are connected with two ends of the first manifold 20 respectively, and an other end of one of the two first tubes 61 and an other end of the other of the two first tubes 61 are connected with inlet ends of the two second heat exchange portions 40 respectively; one end of one of the two second tubes 62 and one end of an other of the two second connecting tubes 62 are connected with two ends of the second manifold 30 respectively, and an other end of one of the two second tubes 62 and an other end of the other of the two second tubes 62 are connected with outlet ends of the two second heat exchange portions 40 respectively. The structure of connecting two first tubes 61 and two second tubes 62 is simple in structure and convenient in connection. There is no need for additional improvements to the manifold.

In the present embodiment, the heat exchanger further includes two first collecting tubes 71 and two first collecting tubes 72, the two first collecting tubes 71 are directly connected with two ends of the first manifold 20 respectively, and the two first tubes 61 and the two first collecting tubes 71 are disposed in a one-to-one correspondingly manner, and each of the two first tubes 61 is connected with a corresponding first collecting tube 71 of the two first collecting tubes 71, so that each of the first tubes 61 is connected with the first manifold 20 by means of the corresponding first collecting tube 71. The two second collecting tubes 72 are directly connected with two ends of the second manifold 30 respectively, the two second tubes 62 and the two second collecting tubes 72 are disposed in a one-to-one correspondingly manner, and each of the two second tubes 62 is connected with a corresponding second collecting tube 72 of the two second collecting tubes 72, so that each of the two second tubes 62 is connected with the second manifold 30 by means of the corresponding second collecting tube 72.

As shown in FIGS. 27 to 31, Embodiment 9 of the present disclosure provides a heat exchanger, in which the second heat exchange portions 40 are disposed to be inclined to an inner side of the installation region 113. Such a structure arrangement can facilitate discharge of water.

In the present embodiment, the second heat exchange portion 40 has a top end 43 and a bottom end 44 opposite to each other, the top end 43 of the second heat exchange portion 40 is disposed at a connection between the first heat exchange tube section 111 and the second heat exchange tube section 112, and the bottom end 44 of the second heat exchange portion 40 is disposed at an end of the first heat exchange tube section 111 away from the second heat exchange tube section 112. The top end 43 of the second heat exchange portion 40 is arranged to be inclined to the inner side of the installation region 113 relative to the bottom end 44 of the second heat exchange portion 40. Such a structure arrangement can facilitate discharge of water and achievement of a wind shield effect.

Embodiment 10 of the present disclosure provides a heat exchanger, the heat exchanger includes a first heat exchange portion 10, a first manifold 20 (the first manifold 20 can be an inlet manifold), a second manifold 30 (the second manifold 30 can be an outlet manifold), a second heat exchange portion 40 and a intermediate manifold 80. The first heat exchange portion 10 includes a plurality of first flat tubes 11 disposed at intervals, each of the plurality of first flat tubes 11 includes a first heat exchange tube section 111 and a second heat exchange tube section 112 connected with each other, and the first heat exchange tube section 111 and the second heat exchange tube section 112 are disposed at a preset angle, so as to form an A-type heat exchanger structure. The first heat exchange tube sections 111 of the plurality of first flat tubes 11 are all connected with the first manifold 20, and the second heat exchange tube sections 112 of the plurality of first flat tubes 11 are connected with the second manifold 30. The second heat exchange portion 40 is at least partially disposed at an end portion of the first heat exchange portion 10 to enclose to form an air duct. The intermediate manifold 80 has an inlet tube section 81 and an outlet tube section 82 independent of each other, the inlet end of the second heat exchange portion 40 is connected with the inlet tube section 81, and the outlet end of the second heat exchange portion 40 is connected with the outlet tube section 82; an inlet end of the inlet tube section 81 is connected with the first manifold 20, and an outlet end of the outlet tube section 82 is connected with the second manifold 30. It should be noted that the air duct in the feature that "the second heat exchange portion 40 is at least partially disposed at an end portion of the first heat exchange portion 10 to enclose to form an air duct" refers to a main flow passage through which air enters the heat exchanger.

According to the heat exchanger provided in the embodiment 10, the second heat exchange portion 40 is disposed at the end portion of the first heat exchange portion 10, and the second heat exchange portion 40 at least partially enclose with the first heat exchange portion 10 to form the air duct, in this way, when air enters the air duct, both the first heat exchange portion 10 and the second heat exchange portion 40 can perform heat exchange, so that the second heat exchange portion 40 can perform effective heat exchange while functioning as a wind shield, the overall heat exchange area of the heat exchanger is increased, the heat exchange performance is improved, and the area is utilized effectively, thereby improving the compactness of the area layout. Therefore, by using the heat exchanger provided in the present embodiment, the technical problem in the art known to inventors of poor heat exchange performance of A-type heat exchangers is solved.

A fluid in the first manifold 20 will flow into the first heat exchange portion 10 and flow into the second heat exchange portion 40 by means of the inlet tube section 81 of the intermediate manifold 80, the heat exchanged fluid in the first heat exchange portion 10 will flow into the second manifold 30, and the heat exchanged fluid in the second heat exchange portion 40 will flow into the second manifold 30 by means of the outlet tube section 82. An inlet connecting pipe 101 is disposed at the first manifold 20, and an outlet connecting pipe 102 is disposed at the second manifold 30. The inlet tube section 81 and the outlet tube section 82 are separated by a partition plate 83.

As shown in FIGS. 32 to 37, in embodiment 10, the second heat exchange portion 40 includes at least two heat exchange structures 45 independently arranged, there are at least two intermediate manifolds 80, and the at least two heat exchange structures 45 are disposed at intervals in an extension direction from one end of the first heat exchange portion 10 to an other end of the first heat exchange portion 10. The at least two heat exchange structures 45 and the at least two intermediate manifolds 80 are disposed in a one-to-one correspondingly manner, and each of the heat exchange structures 45 is connected with a corresponding intermediate manifold 80 of the at least two intermediate manifolds 80. With such a structure arrangement, it is convenient for each of the heat exchange structures 45 to communicate with the first manifold 20 and the second manifold 30 respectively by means of the corresponding intermediate manifold 80, so that each of the heat exchange structures 45 performs independent heat exchange. In addition, by arranging a layout direction in which the at least two independent heat exchange structures 45 are disposed at intervals, the area can be fully used conveniently, and while further improving the compactness of the area layout, the heat exchange performance of the heat exchanger is also effectively improved. In some embodiments, the first heat exchange portion 10 further includes first fins 12.

In the present embodiment, the second heat exchange portion 40 includes two heat exchange structures 45 independently arranged, and the two heat exchange structures 45 are respectively disposed at two ends of the first heat exchange portion 10. There are two intermediate manifolds 80, two heat exchange structures 45 and the two intermediate manifolds 80 are disposed in a one-to-one correspondingly manner, and each of the heat exchange structures 45 is connected with a corresponding intermediate manifold 80 of the two intermediate manifolds 80. Such a structural arrangement can facilitate in functioning as a wind shield, making full use of space, improving the compactness of the structure layout, and also improving the heat exchange performance of the heat exchanger.

An installation region is provided between the first heat exchange tube sections 111 and the second heat exchange tube sections 112, the installation region is a triangular region, the heat exchange structures 45 are installed in the triangular region, and an appearance of each of the heat exchange structures 45 is a triangular or trapezoidal structure fitting the installation region, each of the heat exchange structures 45 is at least partially fitted to the first heat exchange tube sections 111 or the second heat exchange tube sections 112. By means of such a structural arrangement, the wind shield performance can be improved, the stability of the arrangement of the heat exchange structure 45 can be improved, the structural layout is optimized, and the compactness of the structural layout is improved. In order to make full use of the heat exchange area of the heat exchanger and function as a wind shield, the overall dimension of the second heat exchange portion 45 can be completely consistent with the spatial dimension between the first heat exchange tube sections 111 and the second heat exchange tube sections 112 of the first heat exchange portion 10, so as to make full use of the area and function as a wind shield.

In the present embodiment, the angle between the first heat exchange tube sections 111 and the second heat exchange tube sections 112 forms an apex angle of the triangular region, and the apex angle of the triangular region is the same as the apex angle of the triangular structure or trapezoid structure. Such a structure arrangement can facilitate the second heat exchange portion 40 in better filling in the installation region, so as to better achieve a blocking effect.

In the present embodiment, each of the heat exchange structures 45 includes a plurality of third flat tubes 46 disposed at intervals in a height direction, inlet ends of the third flat tubes 46 are connected with the inlet tube section 81, and outlet ends of the third flat tubes 46 are connected with the outlet tube section 82. By means of such a structural arrangement, a normal heat exchange flow path can be formed conveniently, so as to improve the heat exchange efficiency.

In the present embodiment, each of the third flat tubes 46 includes a first tube section 461, a second tube section 462 and a third tube section 463 which are connected in sequence; the first tube section 461 and the third tube section 463 all extend in a vertical direction or in a direction forming a predetermined angle with the vertical direction; the second tube section 462 extend in a horizontal direction or in a direction forming a predetermined angle with the horizontal direction; one end of the first tube section 461 away from the second tube section 462 forms an inlet end of each of the third flat tubes 46; and one end of the third tube section 463 away from the second tube section 462 forms an outlet end of each of the third flat tubes 46. Such a structure arrangement can facilitate the forming of a triangular structure, and facilitate the forming of a complete heat exchange flow path. In some embodiments, the first tube section 461 and the third tube section 463 can all disposed to be inclined with respect to the vertical direction, i.e. the first tube section 461 and the third tube section 463 are all disposed to be inclined to the inner side of the installation region. In this way, it can facilitate discharge of water and improvement of the heat exchange area.

In an extension direction from a bottom end of each of the heat exchange structures 45 to a top end of each of the heat exchange structures 45, lengths of a plurality of second tube sections 462 of the plurality of third flat tubes 46 gradually decrease, and lengths of a plurality of first tube sections 461 of the plurality of third flat tubes 46 or lengths of a plurality of third tube sections 463 of the plurality of third flat tubes 46 gradually increase. In some embodiments, the lengths of the plurality of first tube sections 461 and the plurality of third tube sections gradually increase, so that a triangular structure can be formed conveniently, so as to be fully filled in the ends of the installation region, thereby facilitating effective achievement of wind shield and heat exchange.

In the present embodiment, each of the third flat tubes 46 is of an integrally formed structure. A connection between the first tube section 461 and the second tube section 462 is an arc-shaped bent transition structure; or a connection between the second tube section 462 and the third tube section 463 is an arc-shaped bent transition structure; or the connection between the first tube section 461 and the second tube section 462 is an arc-shaped bent transition structure and the connection between the second tube section 462 and the third tube section 463 are all arc-shaped bent transition structures. In the present embodiment, the connection between the first tube section 461 and the second tube section 462 is an arc-shaped bent transition structure and the connection between the second tube section 462 and the third tube section 463 are all arranged as arc-shaped bent transition structures, thereby reducing the phenomenon of stress concentration at the connections, facilitating smooth transition, and improving the structure strength. In some embodiments, the third flat tube 46 can be formed by bending.

In the present embodiment, the two heat exchange structures 45 in a triangular structure are independently arranged, the first tube section 461 and the third tube section 463 in the heat exchange structure 45 mainly have a function of heat exchange, the second tube sections 462 extend in a transverse direction, and the second tube sections 462 mainly have a function of connecting the first tube section 461 and the third tube section 463. The arc-shaped bent transition structure can be a bent circle, or the bent circle can be flattened, and the form of the bending is not limited.

Figure 38:
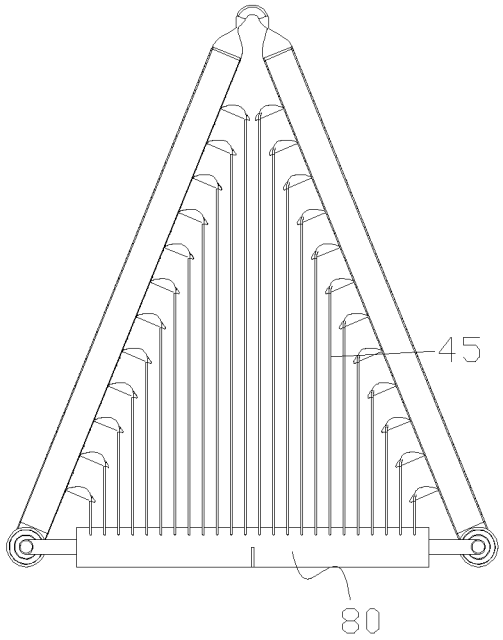
FIG. 38 illustrates a front view of a heat exchanger provided according to Embodiment 11 of the present disclosure.
Figure 39:
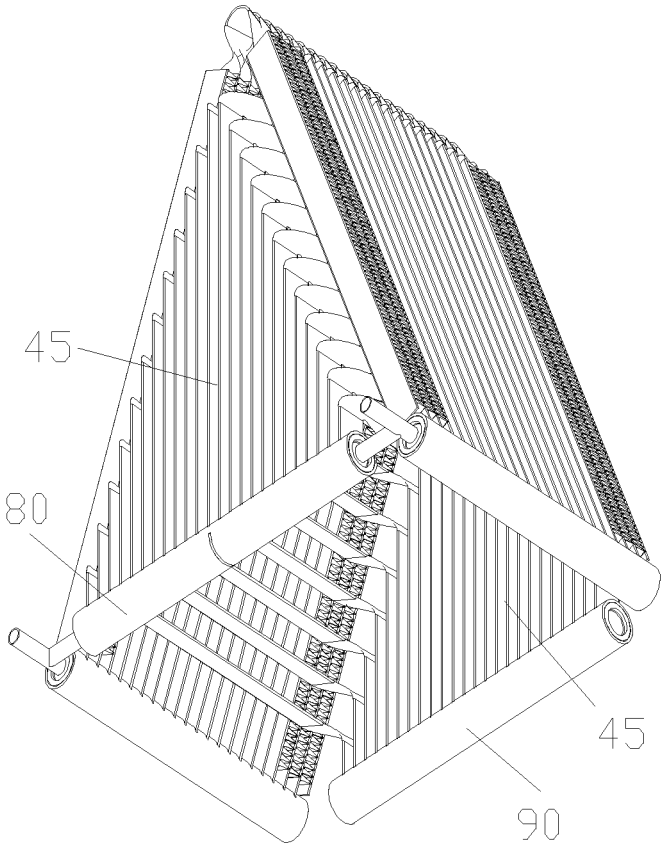
FIG. 39 illustrates a schematic structural diagram of a heat exchanger provided according to Embodiment 11 of the present disclosure.
Figure 40:
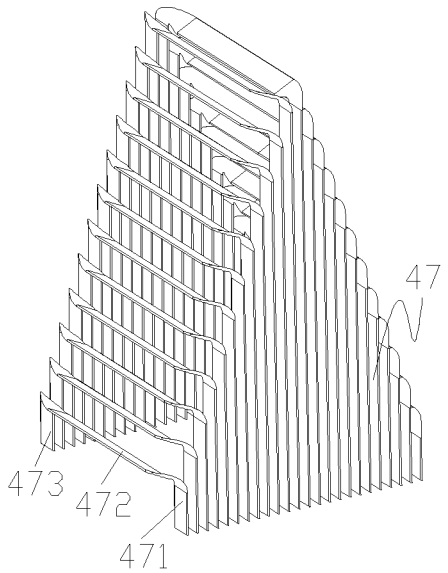
FIG. 40 illustrates a schematic structural diagram of a heat exchange structure according to Embodiment 11 of the present disclosure.
Figure 41:
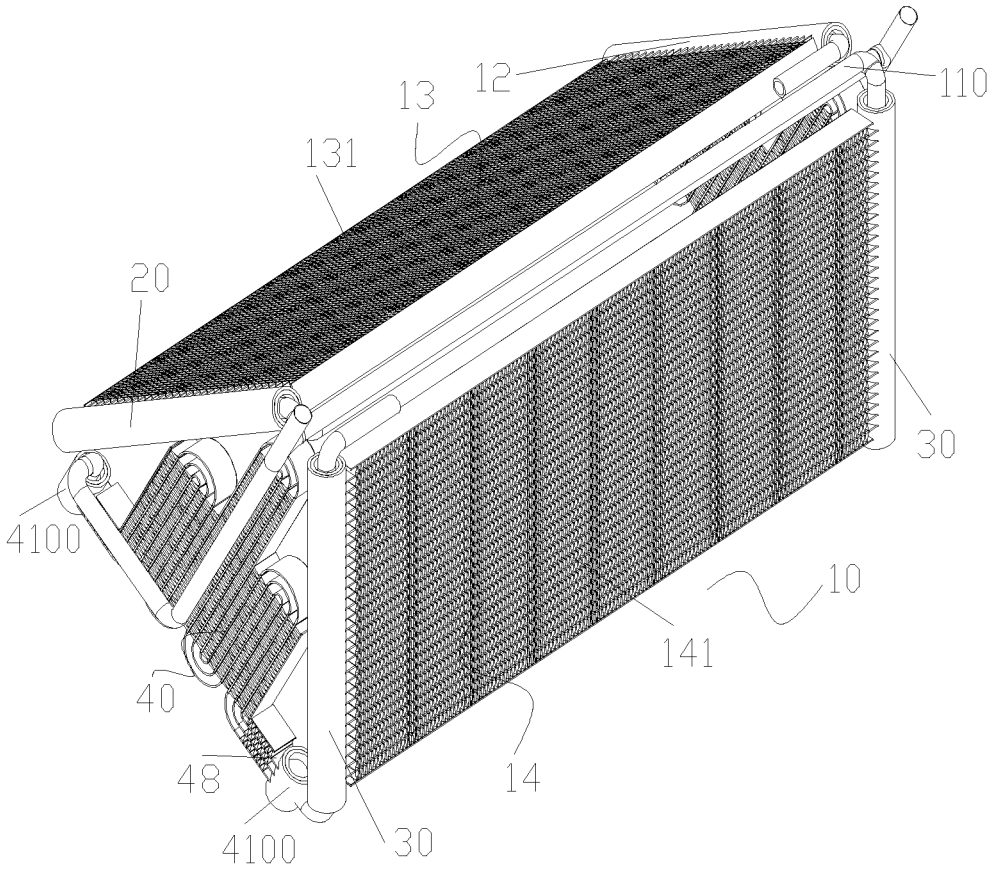
FIG. 41 illustrates a schematic structural diagram of a heat exchanger provided according to Embodiment 12 of the present disclosure.
Figure 42:
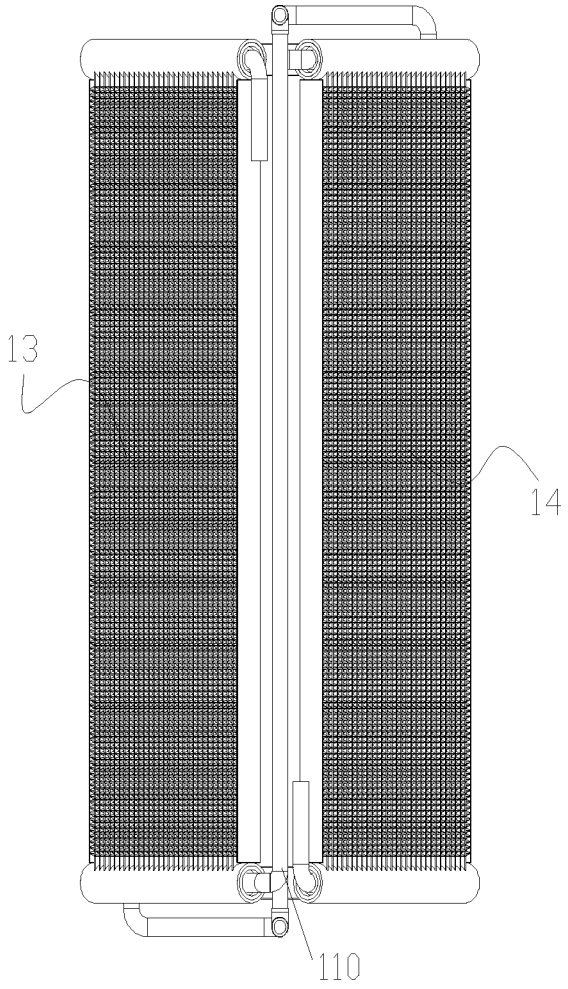
FIG. 42 illustrates a top view of FIG. 41.
Figure 43:
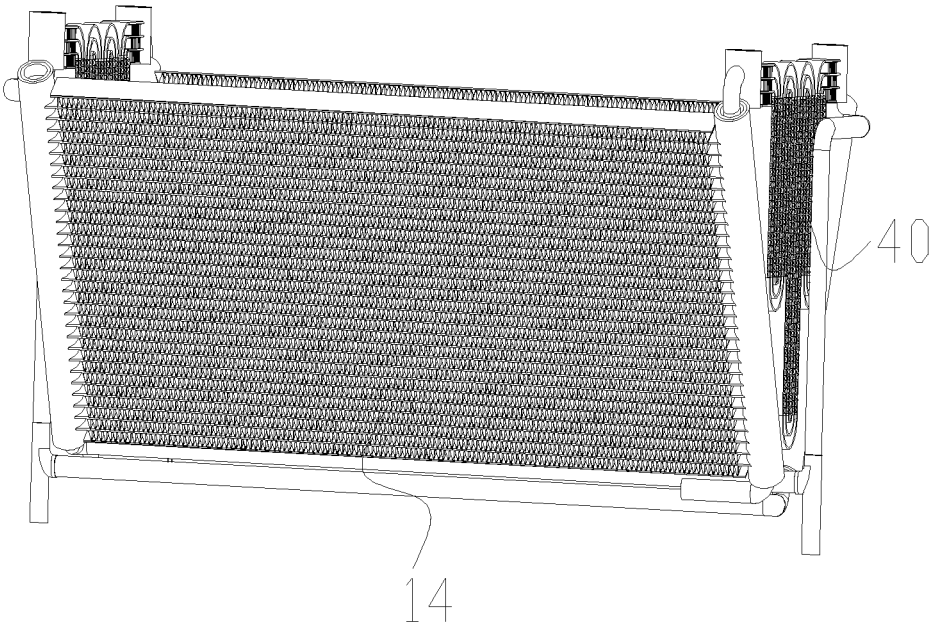
FIG. 43 illustrates a schematic structural diagram from another angle of a heat exchanger provided according to Embodiment 12 of the present disclosure.
Figure 44:
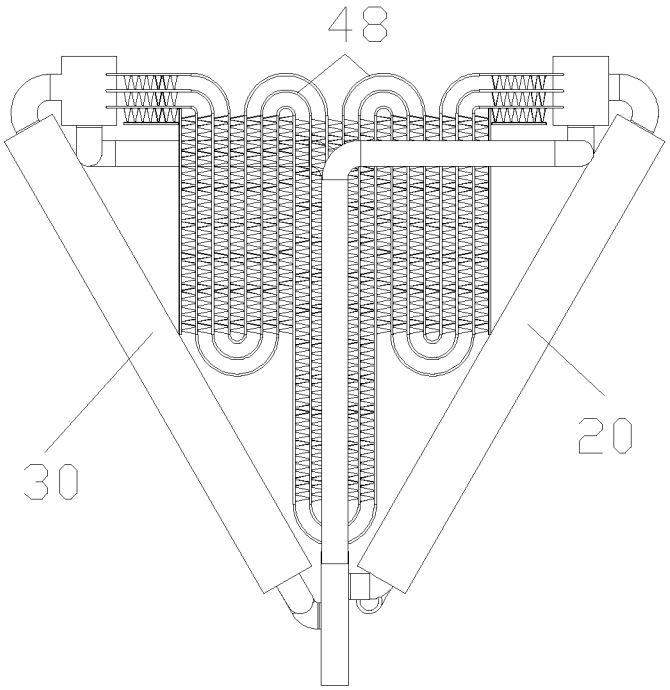
FIG. 44 illustrates a left view of FIG. 43.
Figure 45:
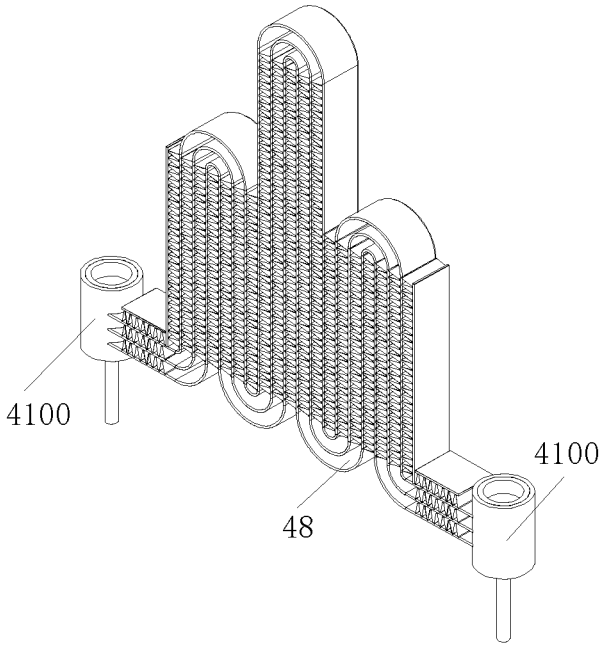
FIG. 45 illustrates a schematic structural diagram of a second heat exchange portion of a heat exchanger provided according to Embodiment 12 of the present disclosure.
Figure 46:
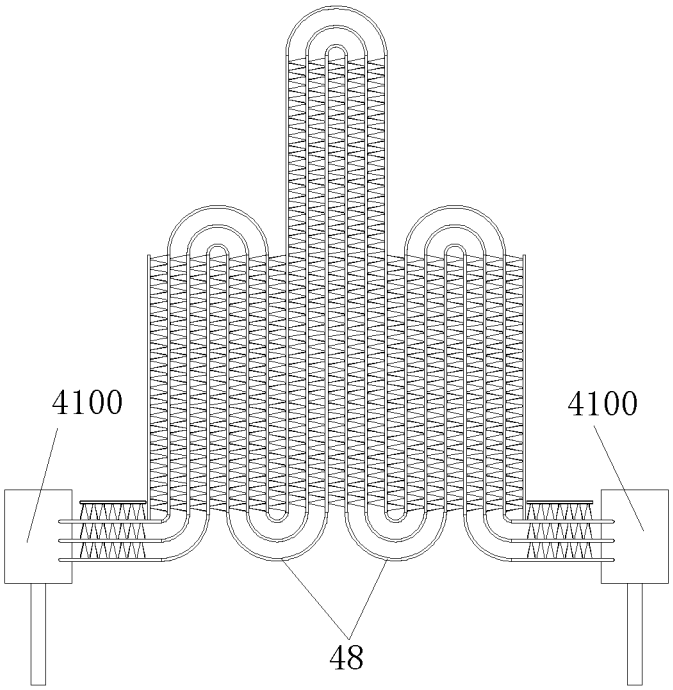
FIG. 46 illustrates a front view of FIG. 45.
Figure 47:
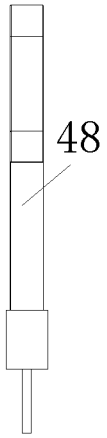
FIG. 47 illustrates a left view of FIG. 45.
Figure 48:
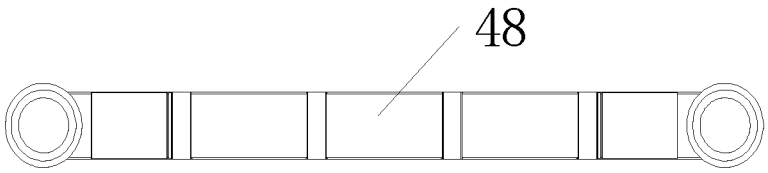
FIG. 48 illustrates a top view of FIG. 45.
Figure 49:
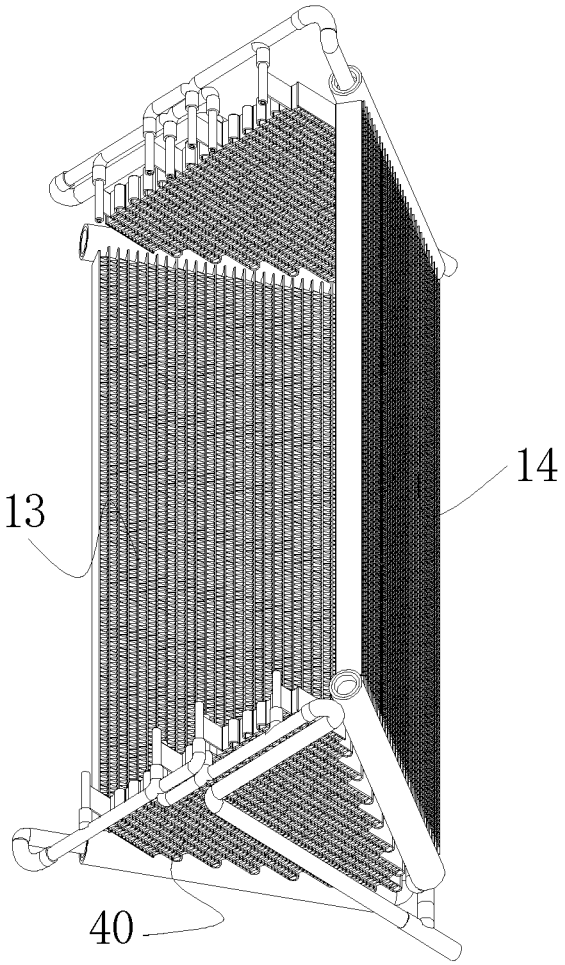
FIG. 49 illustrates a schematic structural diagram of a heat exchanger provided according to Embodiment 13 of the present disclosure.
Figure 50:
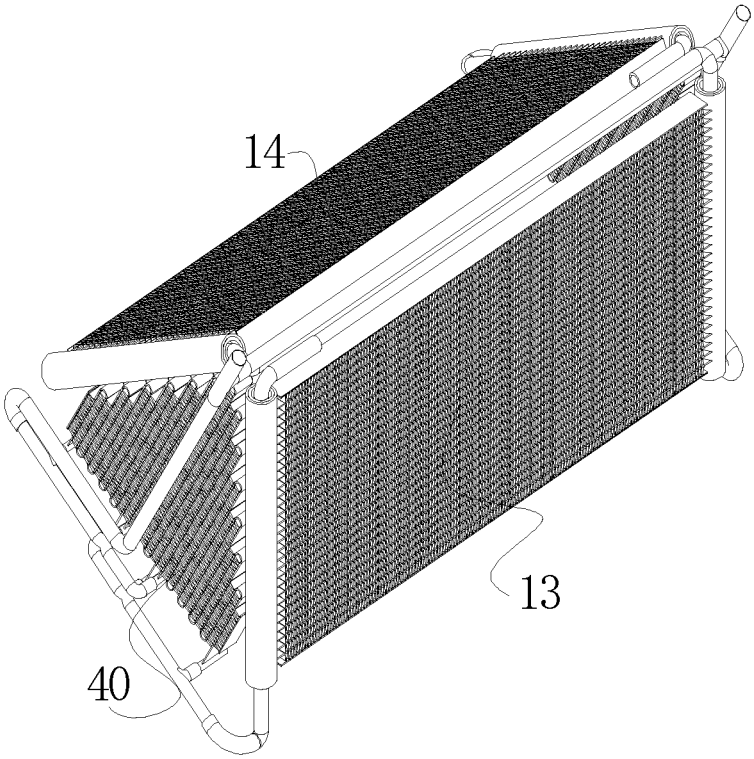
FIG. 50 illustrates a schematic structural diagram from another angle of a heat exchanger provided according to Embodiment 13 of the present disclosure.
Figure 51:
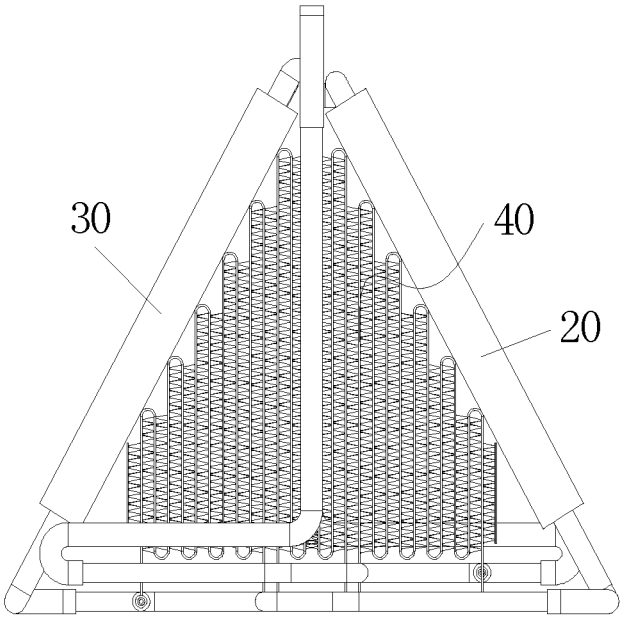
FIG. 51 illustrates a left view of FIG. 50.
Figure 52:
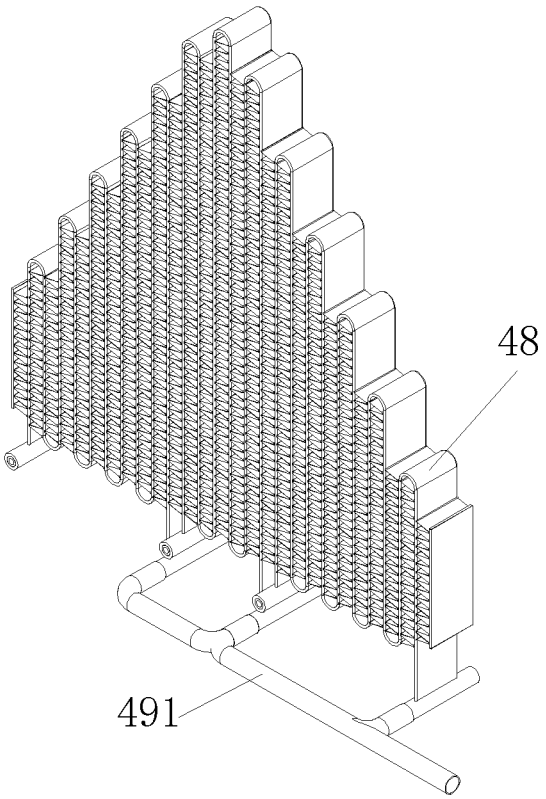
FIG. 52 illustrates a schematic structural diagram of a second heat exchange portion of a heat exchanger provided according to Embodiment 13 of the present disclosure.
Figure 53:
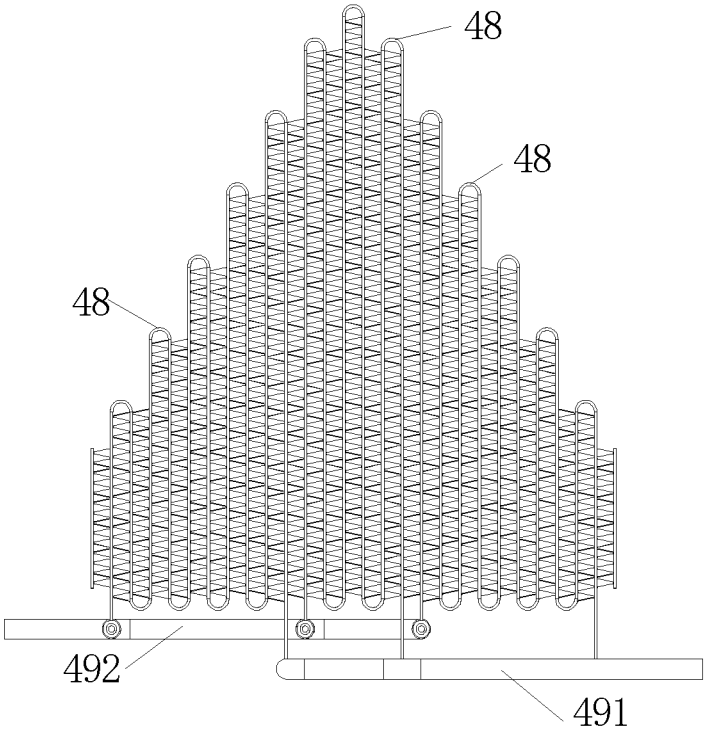
FIG. 53 illustrates a front view of FIG. 52.
Figure 54:
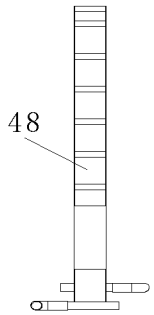
FIG. 54 illustrates a left view of FIG. 52.
Figure 55:
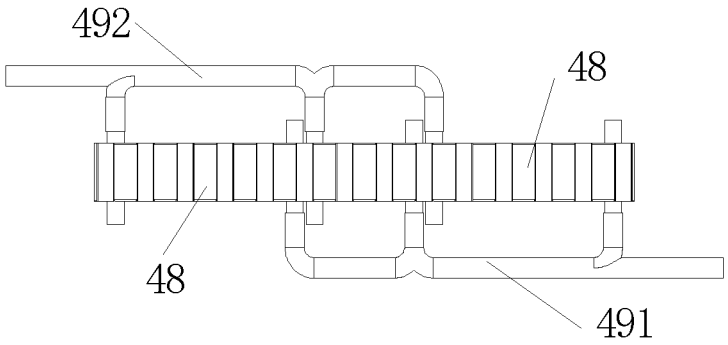
FIG. 55 illustrates a top view of FIG. 52.
Figure 56:
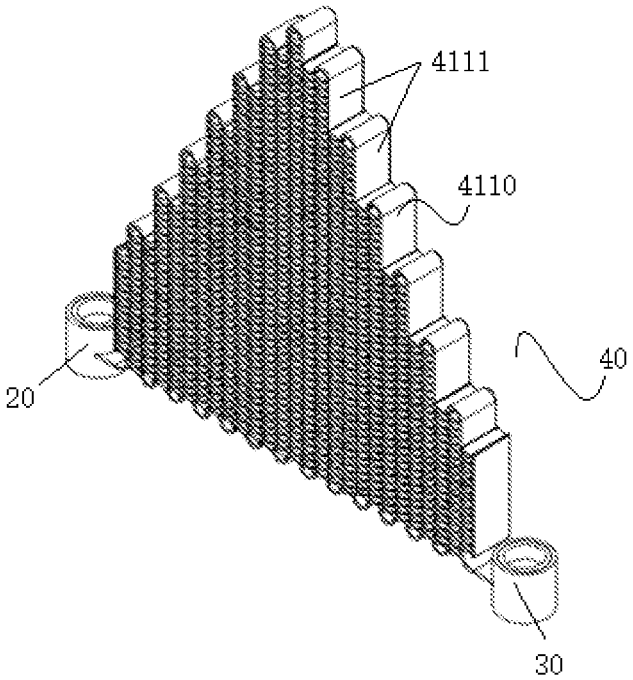
FIG. 56 illustrates a schematic structural diagram of a heat exchange assembly provided according to Embodiment 14 of the present disclosure.
Figure 57:
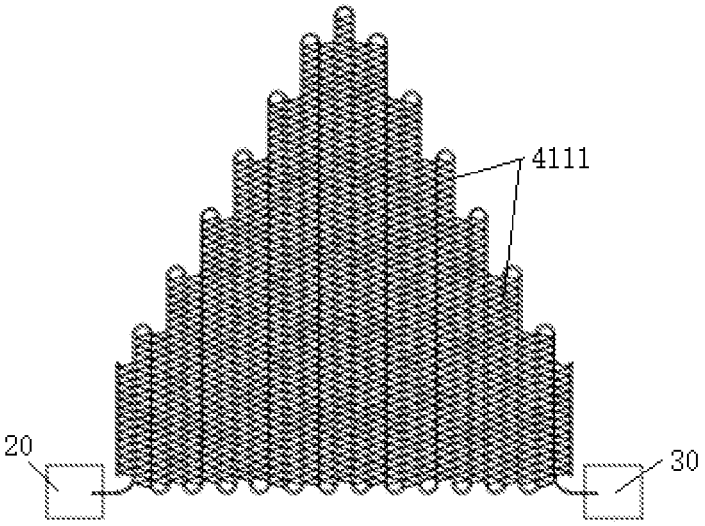
FIG. 57 illustrates a front view of a heat exchange assembly provided according to a Embodiment 14 of the present disclosure.
Figure 58:
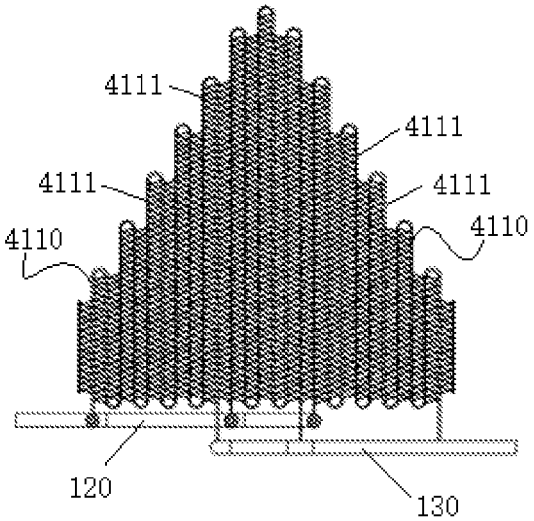
FIG. 58 illustrates a front view of a heat exchange assembly provided according to Embodiment 15 of the present disclosure.
Figure 59:
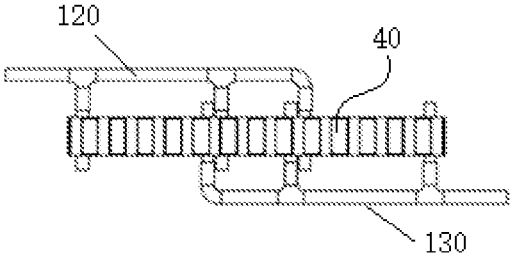
FIG. 59 illustrates a top view of a heat exchange assembly provided according to Embodiment 15 of the present disclosure.
Figure 60:
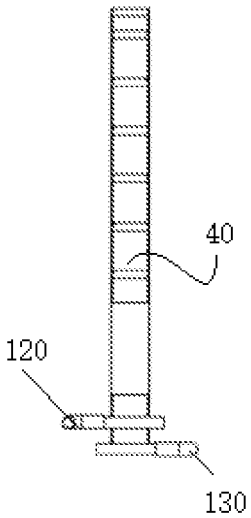
FIG. 60 illustrates a left view of a heat exchange assembly provided according to Embodiment 15 of the present disclosure.
Figure 61:
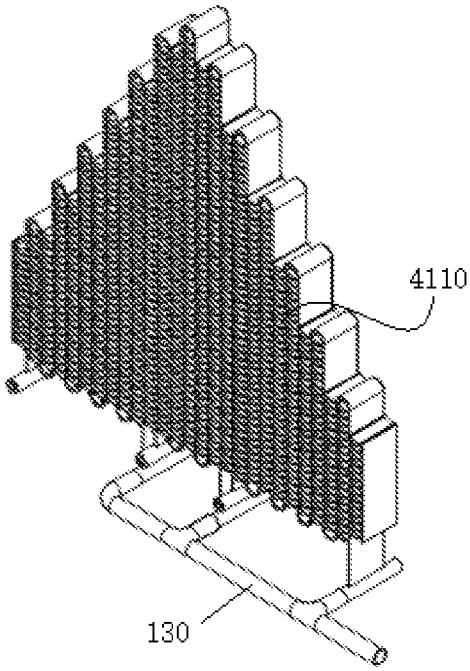
FIG. 61 illustrates a schematic structural diagram of a heat exchange assembly provided according to Embodiment 15 of the present disclosure.
Figure 62:
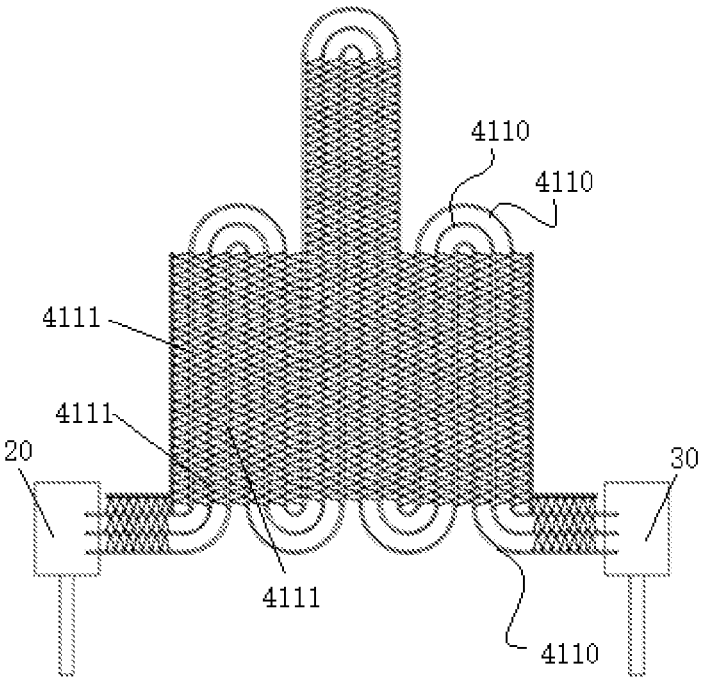
FIG. 62 illustrates a front view of a heat exchange assembly provided according to Embodiment 16 of the present disclosure.
Figure 63:
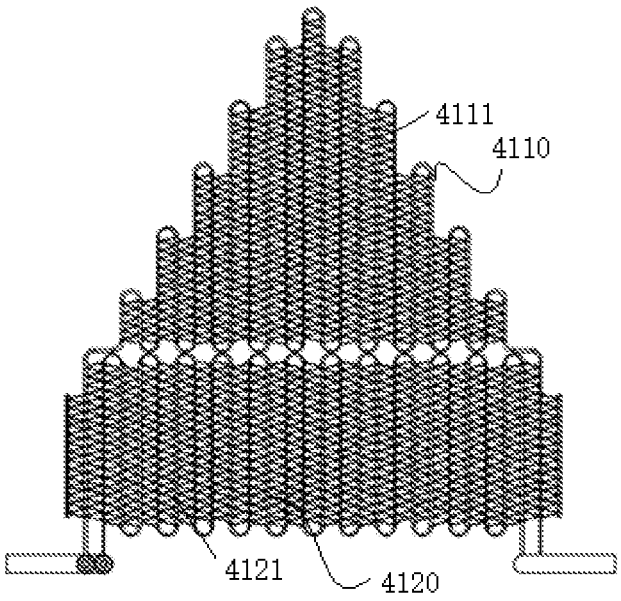
FIG. 63 illustrates a front view of a heat exchange assembly provided according to Embodiment 17 of the present disclosure.
Figure 64:
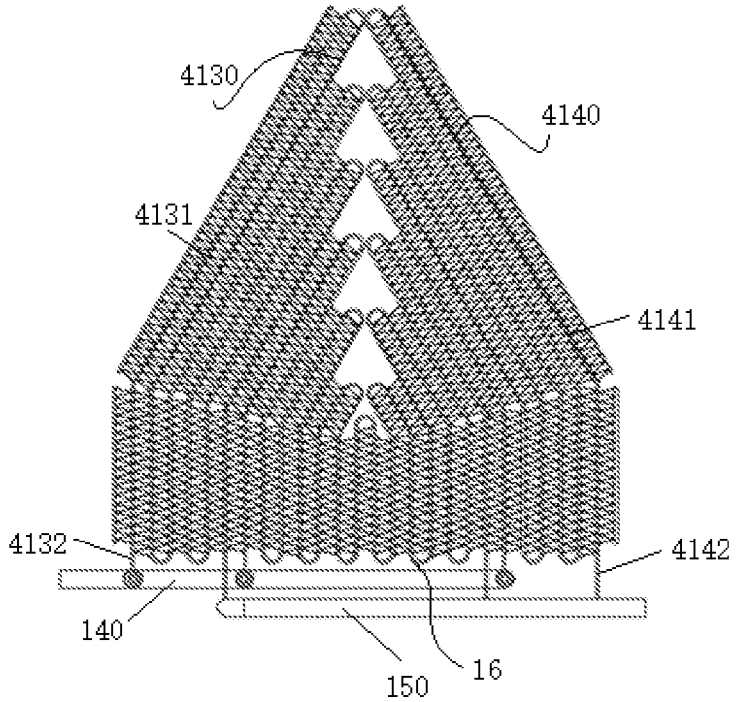
FIG. 64 illustrates a front view of a heat exchange assembly provided according to Embodiment 18 of the present disclosure.
Figure 65:
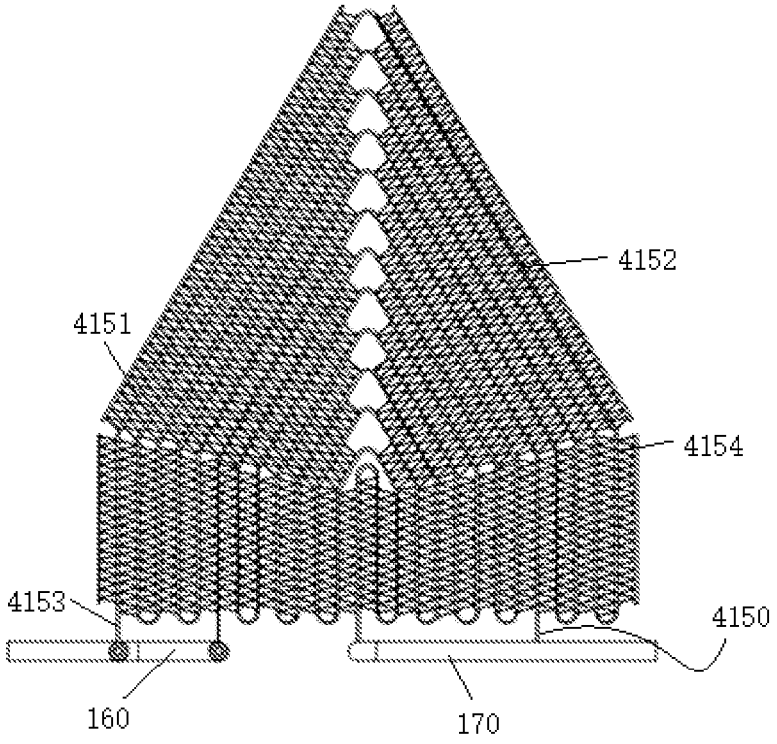
FIG. 65 illustrates a front view of a heat exchange assembly provided according to Embodiment 19 of the present disclosure.

As shown in FIGS. 38 to 40, Embodiment 11 of the present disclosure provides a heat exchanger, and the heat exchanger in the present embodiment differs from the heat exchanger in embodiment 1 lies in that heat exchange structure 45 of the second heat exchange portion 40 has a different structure and a different connection manner. In the present embodiment, the heat exchanger further includes a connecting pipe 90, and the connecting pipe 90 and the intermediate manifold 80 are respectively disposed at two ends of the first heat exchange portion 10. The second heat exchange portion 40 includes two heat exchange structures 45 in communication with each other, wherein the two heat exchange structures 45 are respectively disposed at two ends of the first heat exchange portion 10, one of the heat exchange structures 45 is connected with the connecting pipe 90, and an other one of the heat exchange structures 45 is connected with the intermediate manifold 80, so that fluid entering through the inlet tube section 81 is discharged from the outlet tube section 82 after passing through the two heat exchange structures 45. Such a structural arrangement can facilitate in functioning as a wind shield, making full use of space, improving the compactness of the structure layout, and also improving the heat exchange performance of the heat exchanger.

In the present embodiment, each of the second heat exchange portions 40 further includes: a fourth flat tube 47, the fourth flat tube 47 including a fourth tube section 471, a fifth tube section 472 and a sixth tube section 473 which are sequentially connected, the fourth tube section 471 and the sixth tube section 473 both extending in a vertical direction or in a direction forming a predetermined angle with the vertical direction, the fourth tube section 471 being disposed at one end of the first heat exchange portion 10 and is connected with the intermediate manifold 80, the fifth tube section 472 being disposed between one end of the first heat exchange portion 10 and an other end of the first heat exchange portion 10, and the sixth tube section 473 being disposed at the other end of the first heat exchange portion 10 and is connected with the connecting pipe 90. There are a plurality of fourth flat tubes 47, the plurality of fourth flat tubes 47 are disposed at intervals in an extension direction of the intermediate manifolds 80, a plurality of fourth tube sections 471 enclose to form one heat exchange structure 45, a plurality of sixth tube sections 473 enclose to form another heat exchange structure 45, and one heat exchange structure 45 is connected with another heat exchange structure 45 by means of a plurality of fifth tube sections 472. By means of such a structural arrangement, the installation region is effectively utilized, the structural layout is compact, and the heat exchange performance of the heat exchanger is also effectively improved.

In the present embodiment, all the fourth tube sections 471 and the sixth tube sections 473 can extend in a direction at a predetermined angle with respect to the vertical direction, such that all the fourth tube sections 471 and the sixth tube sections 473 are arranged to be inclined to the installation region between the first heat exchange tube sections 111 and the second heat exchange tube sections 112, so as to facilitate discharge of water and increase the heat exchange area. In this way, the lengths of the fifth tube sections 472 gradually decrease in a direction from the bottom end (corresponding to the opening end of the first heat exchange portion 10) to the top end (corresponding to the connection between the first heat exchange tube section 111 and the second heat exchange tube section 112 of the first heat exchange portion 10) of the heat exchange structure 45.

In the present embodiment, an installation region is provided between the first heat exchange tube sections 111 and the second heat exchange tube sections 112, the installation region is a triangular region, and at least a part of the heat exchange structures 45 is fitted to the first heat exchange tube sections 111 or the second heat exchange tube sections 112. In the extension direction of the intermediate manifold 80, lengths of fourth tube sections 471 of the plurality of fourth flat tubes 47 firstly increase and then decrease, so that the plurality of fourth tube sections 471 form a triangle structure or a trapezoid structure fitting the installation region; or, in the extension direction of the intermediate manifolds 80, lengths of six tube sections 473 of the plurality of fourth flat tubes 47 firstly increase and then decrease, so that the plurality of six tube sections 473 form a triangle structure or a trapezoid structure fitting the installation region. Alternatively, in the extension direction of the intermediate manifold 80, the lengths of the plurality of fourth tube sections 471 and sixth tube sections 473 increase first and then decrease, so that one heat exchange structure 45 enclosed by the plurality of fourth tube sections 471 and the other heat exchange structure 45 enclosed by the plurality of sixth tube sections 473 can both enclose to form a triangular structure or a trapezoid structure fitting the installation region.

In the extension direction of the intermediate manifold 80, the length of the plurality of fourth tube sections 471 and the length of the plurality of sixth tube sections 473 increase first and then decrease. By means of such a structure arrangement, the structure is simple, the layout is compact, the structure layout is optimized, and the heat exchange performance is improved.

The fourth flat tube 47 is of an integrally formed structure. A connection between the fourth tube section 471 and the fifth tube section 472 is an arc-shaped bent transition structure; or, a connection between the fifth tube section 472 and the sixth tube section 473 is an arc-shaped bent transition structure; or the connection between the fourth tube section 471 and the fifth tube section 472 and the connection between the fifth tube section 472 and the sixth tube section 473 are all arc-shaped bent transition structures.

In the present embodiment, the connection between the fourth tube section 471 and the fifth tube section 472 and the connection between the fifth tube section 472 and the sixth tube section 473 are all arranged as arc-shaped bent transition structures, thereby reducing the phenomenon of stress concentration at the connection, facilitating smooth transition, and improving the structure strength. In the present embodiment, the fourth flat tube 47 can be formed by bending.

The fourth tubular section 471 and the sixth tubular section 473 in the fourth flat tube 47 mainly function to exchange heat, the fifth tubular section 472 functions to connect the fourth tubular section 471 and the sixth tubular section 473, and the shape and structure of the fifth tubular section 472 is not limited.

As shown in FIGS. 41 to 55, Embodiment 12 of the disclosure provides a heat exchanger, the heat exchanger includes a first heat exchange portion 10 and a second heat exchange portion 40, the first heat exchange portion 10 includes a first heat exchange assembly 13 and a second heat exchange assembly 14 connected with each other, the first heat exchange assembly 13 includes a first manifold 20 and a plurality of first heat exchange flat tubes 131 connected with each other, and the plurality of first flat heat exchange tubes 131 are disposed at intervals in a first preset direction. The second heat exchange assembly 14 is connected with the first heat exchange assembly 13, the second heat exchange assembly 14 includes a second manifold 30 and a plurality of second flat heat exchange tubes 141 which are connected with each other, the plurality of second flat heat exchange tubes 141 are disposed at intervals in a second preset direction, and the first preset direction and the second preset direction form a preset angle; the second heat exchange portion 40 is disposed at an end portion of the first heat exchange assembly 13 and the second heat exchange assembly 14, and the first heat exchange assembly 13, the second heat exchange assembly 14 and the second heat exchange portion 40 enclose to form an air duct. It should be noted that, the air duct herein refers to a main circulation passage for air to enter the heat exchanger. The first heat exchange assembly 13, the second heat exchange assembly 14 and the second heat exchange portion 40 are all connected by means of the joint pipe 110.

According to the heat exchanger provided in the present embodiment, the first heat exchange assembly 13, the second heat exchange assembly 14, and the second heat exchange portion 40 enclose to form an air duct. In this way, not only can the second heat exchange portion 40 function as a wind shield, but also the first heat exchange assembly 13, the second heat exchange assembly 14 and the second heat exchange portions 40 can exchange heat, thereby increasing the overall heat exchange area, improving the heat exchange performance, effectively utilizing area, and improving the compactness of the area layout. In addition, by connecting the first heat exchange assembly 13 and the second heat exchange assembly 14 by means of the joint pipe 110, the first flat heat exchange tube 131 of the first heat exchange assembly 13 can be a long straight tube section, and the second flat heat exchange tube 141 of the second heat exchange assembly 14 can also be a long straight tube section, and as there is no bent tube section structure, the structure is simple. Therefore, by using the heat exchanger provided in the present embodiment, the technical problem in the art known to inventors of poor heat exchange performance of A-type heat exchangers is solved.

In the present embodiment, there is an installation region between the first heat exchange assembly 13 and the second heat exchange assembly 14, and the second heat exchange portion 40 is disposed in the installation region. Such an installation manner can facilitate further optimization of the installation position of the second heat exchange portion 40, thereby optimizing the overall structure layout of the second heat exchange portion 40, effectively increasing the overall heat exchange area of the heat exchanger, and improving the heat exchange performance.

In the present embodiment, the installation region is a triangular region, the second heat exchange portion 40 is a triangular or trapezoidal structure fitting the installation region, and the second heat exchange portion 40 is partially fitted to the first heat exchange assembly 13 and the second heat exchange assembly 14. By using such a structural arrangement, the wind shield performance can be improved, the stability of the arrangement of the second heat exchange portions 40 can be improved, the structural arrangement is optimized, and the compactness of the structural layout is improved. In order to make full use of the heat exchange area of the heat exchanger and effectively function as a wind shield, in the present embodiment, the overall dimension of the second heat exchange portion 40 can be completely consistent with the spatial dimension between the first heat exchange assembly 13 and the second heat exchange assembly 14, so as to make full use of the area and function as a wind shield.

In the present embodiment, the angle between the first heat exchange assembly 13 and the second heat exchange assembly 14 forms an apex angle of the triangular region, and the apex angle of the triangular region is the same as the apex angle of the triangular structure. Such a structure arrangement can facilitate the second heat exchange portion 40 in better filling in the installation region, so as to better achieve a blocking effect and effectively function as a wind shield.

In Embodiment 12, the second heat exchange portion 40 includes a third heat exchange flat tube 48, the third heat exchange flat tube 48 includes a plurality of bent tube sections connected in sequence, and the heights of the plurality of bent tube sections connected in sequence gradually increase first and then gradually decrease, so that the edges of the plurality of bent tube sections connected in sequence enclose to form a triangular structure. Such a structure arrangement has a simple structure, is convenient for forming a triangular structure, and is convenient for production and manufacture; furthermore, the refrigerant flow resistance in the second heat exchange section 40 can also be reduced.

In the present embodiment, there are a plurality of third heat exchange flat tubes 48, and the plurality of third heat exchange flat tubes 48 are disposed at intervals in a height direction, so that the distance between the bent tube sections can be reduced, thereby improving the heat exchange efficiency and effectively functioning as a wind shield. The projections of the plurality of third heat exchange flat tubes 48 in the height direction have an overlapping region. In this way, it can better function as a wind shield, and perform effective heat exchange.

In the present embodiment, third fins are arranged between the plurality of third heat exchange flat tubes 48.

In the present embodiment, the inlet ends of the plurality of third heat exchange flat tubes 48 are connected, and the outlet ends of the plurality of third heat exchange flat tubes 48 are connected, so as to manage the inflow and outflow of the plurality of third heat exchange flat tubes 48. The second heat exchange portion 40 includes a third manifold 4100, the inlet ends of the plurality of third heat exchange flat tubes 48 are connected by means of one third manifold 4100, and the outlet ends of the plurality of third heat exchange flat tubes 48 are connected by means of the other third manifold 4100.

Embodiment 13 of the present disclosure provides a heat exchanger, and the heat exchanger in Embodiment 13 differs from the heat exchanger in Embodiment 12 in the structure of the second heat exchange portion 40. In the present embodiment, the second heat exchange portion 40 includes a plurality of third heat exchange flat tubes 48, the plurality of third heat exchange flat tubes 48 are disposed at intervals in the extension direction from the first heat exchange assembly 13 to the second heat exchange assembly 14, each of the third heat exchange flat tubes 48 includes a plurality of bent tube sections connected in sequence, and the heights of the bent tube sections of the plurality of third heat exchange flat tubes 48 gradually increase first and then gradually decrease, so that the edges of the plurality of third heat exchange flat tubes 48 enclose to form a triangular structure. By means of such a structure arrangement, the structure is simple, the triangular structure is formed conveniently, and the production and manufacture are facilitated. In addition, the refrigerant flow resistance inside a single third heat exchange flat tube 48 can be reduced.

In the present embodiment, the inlet ends of the plurality of third heat exchange flat tubes 48 are connected, and the outlet ends of the plurality of third heat exchange flat tubes 48 are connected, so as to facilitate centralized inflow of the inlet ends of the plurality of third heat exchange flat tubes 48, and facilitate centralized collection of the outlet ends of the plurality of third heat exchange flat tubes 48.

In the present embodiment, the second heat exchange portion 40 further includes: an inlet connecting tube 491, the inlet connecting tube 491 extending in the extension direction from the first heat exchange assembly 13 to the second heat exchange assembly 14, and the inlet ends of the plurality of third heat exchange flat tubes 48 being connected with the inlet connecting tube 491; or the second heat exchange portion 40 further includes: an outlet connecting tube 492, the outlet connecting tube 492 extending in the extension direction from the first heat exchange assembly 13 to the second heat exchange assembly 14, and the outlet ends of the plurality of third heat exchange flat tubes 48 being connected with the outlet connecting tubes 492.

In the present embodiment, the second heat exchange section 40 includes an inlet connecting tube 491 and an outlet connecting tube 492, the inlet connecting tube 491 extends in the extension direction from the first heat exchange assembly 13 to the second heat exchange assembly 14, the inlet ends of the plurality of third heat exchange flat tubes 48 are all connected with the inlet connecting tube 491, so that the refrigerant can be supplied to the plurality of third heat exchange flat tubes 48 in a centralized manner by means of the inlet connecting tube 491, and the refrigerant can be collected from the plurality of third heat exchange flat tubes 48 in a centralized manner by means of the outlet connecting tube 492.

The present disclosure uses two non-bent single-row heat exchangers (including a first heat exchange assembly 13 and a second heat exchange assembly 14) which are connected by the joint pipe 110 to form a V shape, so that, while solving the inherent structural defects in the disclosure of bent heat exchangers, a tube-and-belt heat exchanger (a second heat exchange portion 40) is added to the V-shaped side where two single-row heat exchangers are connected, so that, the effective heat exchange area is further increased, the heat exchange efficiency is improved, the structure is compact, and the area utilization rate is high.

In the present embodiment, the pipes for the two single-row heat exchangers are connected to form a V-shaped heat exchanger without a bent section, and the V-shaped side is filled with a tube-and-band heat exchanger, thereby increasing the heat exchange area and at the same time serving as a wind shield.

In Embodiment 12, in order to reduce the refrigerant flow resistance in the tube-and-belt heat exchanger, three flat tubes can be folded in an overlapping manner into a triangle structure and connected in parallel to the V-shaped single-row heat exchanger. Optionally, in the limited area on the V-shaped side, two or four flat tubes can be folded in an overlapping manner into a triangle, a trapezoid or other shapes, so as to reduce the flow resistance and connect with the V-shaped single-pass heat exchanger.

In Embodiment 13, in order to reduce the refrigerant flow resistance in the tube-and-belt heat exchanger, the second heat exchange portion can be formed by bending and splicing two or three or four tubes into a triangle or trapezoid structure, each of the three flat tubes which has an inlet and an outlet, and the second heat exchange portion is connected with a V-shaped single-pass heat exchanger.

From the above description, it can be determined that Embodiment 12 and Embodiment 13 of the present disclosure achieve the following technical effects: the effective heat exchange area is increased, the heat exchange efficiency is improved, the structure is compact, and the area utilization rate is high.

As shown in FIGS. 1 to 10, the embodiments of the present disclosure provide a heat exchange assembly, the heat exchange assembly includes a bent flat tube structure, the bent flat tube structure has a heat exchange inlet portion, a heat exchange outlet portion, and a bent heat exchange flow path structure communicating with both the heat exchange inlet portion and the heat exchange outlet portion. An edge of the bent flat tube structure encloses to form a triangle structure or a trapezoid structure.

By using the structure of the heat exchanger provided in the present embodiment, in specific use, the sheet metal member in the A-type heat exchanger can be replaced with the heat exchanger assembly, and in this way, a wind shield effect on the A-type heat exchanger can be achieved, the compactness of the structure is improved, and at the same time, the overall heat exchange effect of the A-type heat exchanger can also be effectively improved. Therefore, by using the heat exchange assembly provided in the present embodiment, the heat exchange performance of the heat exchanger A can be effectively improved.

In Embodiment 1, the bent flat tube structure includes a first flat tube 11, the first flat tube 11 includes a plurality of first heat exchange tube sections 111 spaced apart in a horizontal direction and communicating with each other, and each of the first heat exchange tube sections 111 extends in a vertical direction.

In the present embodiment, the heights of the plurality of first heat exchange tube sections 111 increase first and then decrease, one end of the first flat tube 11 forms a heat exchange inlet portion, and the other end of the first flat tube 11 forms a heat exchange outlet portion. By means of such a structure arrangement, a bent flat tube structure can be formed by means of one bent first flat tube 11, the structure is simple, the manufacture is easy to implement, and the manufacture cost is effectively reduced.

In the present embodiment, the heat exchange assembly further includes a first manifold 20 and a second manifold 30, the heat exchange inlet portion is connected with the first manifold 20, and the heat exchange outlet portion is connected with the second manifold 30.

In the present embodiment, the heat exchange assembly is a single-loop tube-and-belt structure, and the structural form can be considered when the overall size of the heat exchange assembly is relatively small.

Embodiment 2 of the present disclosure provides a heat exchange assembly. The bent flat tube structures include: a flat tube 11, the flat tube 11 including a plurality of first heat exchange tube sections 111 spaced apart in the horizontal direction and communicating with each other, the first heat exchange tube sections 111 extending in the vertical direction. There are a plurality of first flat tubes 11, the plurality of first flat tubes 11 being arranged at intervals in a horizontal direction, the heat exchange inlet portion includes a plurality of first heat exchange inlets of the first flat tubes 11, the heat exchange outlet portion includes a plurality of first heat exchange outlets of the first flat tubes 11, the heights of the plurality of first heat exchange tube sections 111 of the plurality of first flat tubes 11 increase first and then decrease. By using such a structure arrangement, the plurality of first flat tubes 11 arranged at intervals in the horizontal direction can facilitate the edges of the bent flat tube structure in forming a triangular structure or a trapezoid structure. In addition, by arranging a plurality of first flat tubes 11, compared with the structure of one flat tube, the length of the heat exchange flow path in each first flat tube 11 can be reduced, thereby reducing the heat exchange resistance of the refrigerant, and facilitating improvement of the heat exchange effect.

In the present embodiment, the plurality of first heat exchange inlets are arranged at intervals, and the plurality of first heat exchange outlets are arranged at intervals. The heat exchange assembly further includes: a first manifold 20, the plurality of first heat exchange inlets being connected with the first manifold 20, and the first manifold 20 extending in a direction in which the plurality of first heat exchange inlets are arranged at intervals; or a second manifold 30, the plurality of first heat exchange outlets being connected with the second manifold 30, and the second manifold 30 extending in a direction in which the plurality of first heat exchange outlets are arranged at intervals.

In the present embodiment, the heat exchange assembly further includes a first manifold 20 and a second manifold 30, the plurality of first heat exchange inlets are connected with the first manifold 20, and the first manifold 20 extends along the interval arrangement direction of the plurality of first heat exchange inlets; The plurality of first heat exchange outlets are all connected with the second manifold 30, and the second manifold 30 extends along the direction in which the plurality of first heat exchange outlets are arranged at intervals. Such a structural arrangement facilitates supply of the refrigerant to the plurality of first heat exchange inlets respectively by means of the first manifold 20, and the refrigerant flowing out of the plurality of first heat exchange outlets can be collected conveniently by means of the second manifold 30.

The heat exchange assembly is a multi-loop tube-and-belt structure, and the structure can be considered when the size of the heat exchanger is relatively long, thereby avoiding a large flow resistance of the refrigerant is large, and avoiding affecting the heat exchange performance.

Embodiment 3 of the present disclosure provides a heat exchange assembly, a bent flat tube structure includes a first flat tube 11, the first flat tube 11 includes a plurality of first heat exchange tube sections 111 spaced apart in a horizontal direction and communicating with each other, and the first heat exchange tube sections 111 all extend in a vertical direction. In the present embodiment, the heights of the plurality of first heat exchange tube sections 111 of the first flat tubes 11 increase first and then decrease, there are plurality of first flat tubes 11, and the plurality of first flat tubes 11 are arranged at intervals in the vertical direction. By means of such a structural arrangement, the number of heat exchange flow paths can be increased effectively, and the heat exchange effect is improved effectively. The structure in the present embodiment is a plurality of single-loop tube-and-belt structure, and is also applicable to a smaller-sized heat exchange assembly.

In the present embodiment, the heat exchange assembly includes a first manifold 20 and a second manifold 30, the heat exchange inlet portion includes a plurality of first heat exchange inlets of the first flat tubes 11, the heat exchange outlet portion includes a plurality of first heat exchange outlets of the first flat tubes 11, and the plurality of first heat exchange inlets are all connected with the first manifold 20 (the first manifold can be an inlet manifold), and the plurality of first heat exchange outlets are all connected with the second manifold 30 (the second manifold can be an outlet manifold).

Embodiment 4 of the present disclosure provides a heat exchange assembly, a bent flat tube structure includes a first flat tube 11, the first flat tube 11 includes a plurality of first heat exchange tube sections 111 spaced apart in a horizontal direction and communicating with each other, and the first heat exchange tube sections 111 all extend in a vertical direction. The heights of the plurality of first heat exchange tube sections 111 of the first flat tube 11 of the heat exchange assembly increase first and then decrease, the bent flat tube structure further includes a second flat tube 41, the second flat tube 41 including a plurality of second heat exchange tube sections 112 spaced apart in the horizontal direction and communicating with each other, the second heat exchange tube section 112 extends in the vertical direction, the plurality of second heat exchange tube sections 112 have the same height, and the plurality of first heat exchange tube sections 111 are installed above the plurality of second heat exchange tube sections 112. By means of such a structure arrangement, a bent flat tube structure with a triangular or trapezoid edge can be formed conveniently. In addition, the structure layout of the heat exchange assembly is also optimized by arranging the layout of the first flat tubes 11 and the second flat tubes 41, thereby improving the structural compactness of the heat exchange assembly, reducing the length of the heat exchange flow path in each flat tube, and further reducing the flow resistance in the corresponding flat tube.

Embodiment 5 of the present disclosure provides the heat exchange assembly, the bent flat tube structure includes a plurality of first inclined sections 4131 and a plurality of second inclined sections 4141, wherein the plurality of first inclined sections 4131 and the plurality of second inclined sections 4141 are disposed in a correspondingly manner, and the first inclined sections 4131 and the corresponding second inclined sections 4141 are correspondingly arranged so as to be spliced to form a triangular structure. The plurality of first inclined sections 4131 are spaced apart in the horizontal direction, the plurality of second inclined sections 4141 are spaced apart in the horizontal direction, the first inclined section 4131 located at the outermost side and the second inclined section 4141 located at the outermost side form the edge of a bent flat tube structure and enclose to form a triangular structure or a trapezoid structure.

Embodiment 6 of the present disclosure provides a heat exchange assembly, the bent flat tube structure includes a third flat tube 46 and a fourth flat tube 47, the third flat tube 46 including a plurality of third heat exchange tube sections spaced apart in the horizontal direction and communicating with each other, the fourth flat tube 47 includes a plurality of fourth heat exchange tube sections spaced apart in the horizontal direction and communicating with each other, each of the third heat exchange tube sections include a first inclined section 4131, each of the fourth heat exchange tube sections includes a second inclined section 4141, the plurality of first inclined sections 4131 and the plurality of second inclined sections 4141 are disposed in a one-to-one correspondingly manner, and each of the first inclined sections 4131 abuts against the corresponding second inclined section 4141 to form a triangular structure. By means of such a structure arrangement, the structure layout of the bent flat tube structure can be optimized, and the compactness of the structure arrangement can be improved. In the present embodiment, the third heat exchange tube section further includes a first vertical section 4132, the first vertical section 4132 being located below the first inclined section 4131 and communicating with the first inclined section 4131, and the fourth heat exchange tube section further includes a second vertical section 4142, the second vertical section 4142 being located below the second inclined section 4141 and communicating with the second inclined section 4141.

In the present embodiment, the heat exchange assembly can further include a sixth flat tube 4120, the sixth flat tube 4120 is located between the third flat tube 46 and the fourth flat tube 47, the sixth flat tube 4120 has a sixth heat exchange tube section, a seventh heat exchange tube section and an eighth heat exchange tube section spaced apart in the horizontal direction and communicating with each other, the sixth heat exchange tube section includes a sixth vertical section and a sixth inclined section connected with each other, the sixth inclined section is located above the sixth vertical section, the seventh heat exchange tube section includes a seventh vertical section, the eighth heat exchange tube section includes an eighth vertical section and an eighth inclined section which are connected with each other, and the eighth inclined section is located above the eighth vertical section. The sixth heat exchange tube section is arranged close to the third heat exchange tube section, the seventh heat exchange tube section is arranged close to the fourth heat exchange tube section, the sixth inclined section and the eighth inclined section enclose to form a triangular structure, and the seventh vertical section is partially located within a triangular region surrounded by the sixth inclined section and the eighth inclined section. By means of such a structural arrangement, the heat exchange assembly includes the third flat tube 46, the fourth flat tube 47 and the sixth flat tube 4120, so that the structural layout of the heat exchange assembly can be optimized, the structural compactness of the heat exchange assembly is improved, and the length of the heat exchange flow path in each flat tube can also be reduced, thereby reducing the heat exchange resistance.

In the present embodiment, the heat exchange assembly further includes a third connecting tube 53 and a fourth connecting tube 54; the heat exchange inlet portion includes a third heat exchange inlet of the third flat tube 46, a fourth heat exchange inlet of the fourth flat tube 47, and a sixth heat exchange inlet of the sixth flat tube 4120; and the heat exchange outlet portion includes a third heat exchange outlet of the third flat tube 46, a fourth heat exchange outlet of the fourth flat tube 47, and a sixth heat exchange outlet of the sixth flat tube 4120. The third connecting tube 53 extends in a direction in which the third heat exchange inlet, the fourth heat exchange inlet and the sixth heat exchange inlet are arranged at intervals; and the third heat exchange inlet, the fourth heat exchange inlet and the sixth heat exchange inlet are all connected to the third connecting tube 53. The fourth connecting tube 54 extends in a direction in which the third heat exchange outlet, the fourth heat exchange outlet and the sixth heat exchange outlet are arranged at intervals; and the third heat exchange outlet, the fourth heat exchange outlet and the sixth heat exchange outlet are all connected to the fourth connecting tube 54.

Embodiment 7 of the present disclosure provides a heat exchange assembly; a bent flat tube structure of the heat exchange assembly includes a fifth flat tube 4110; the fifth flat tube 4110 includes a plurality of fifth heat exchange tube sections spaced apart in a vertical direction and communicating with each other; each of the fifth heat exchange tube sections includes a third inclined section 4151 and a fourth inclined section 4152 that are connected with each other; and the third inclined section 4151 and the fourth inclined section 4152 enclose to form a triangular structure. By means of such a structural arrangement, the structural layout of the heat exchange assembly can be optimized, the structural compactness of the heat exchange assembly is improved, and the triangular structure is also formed by enclosure conveniently.

In the present embodiment, a third vertical section 4153 is disposed at one end of the third inclined section 4151 away from the fourth inclined section 4152, and a fourth vertical section 4154 is disposed at one end of the fourth inclined section 4152 away from the third inclined section 4151.

In the present embodiment, there are a plurality of fifth flat tubes 4110, and the plurality of fifth flat tubes 4110 are disposed at intervals in a direction from an outer side to an inner side of the triangular structure. There are two fifth flat tubes 4110, wherein an installation region is provided between the fifth heat exchange inlet and the fifth heat exchange outlet of one fifth flat tube 4110, and the other fifth flat tube 4110 is installed in the installation region. The structure is compact in layout.

In the present embodiment, the heat exchange assembly further includes a fifth connecting tube 55 and a sixth connecting tube 56, the plurality of fifth heat exchange inlets are all connected with the fifth connecting tube 55, and the plurality of sixth heat exchange inlets are all connected with the sixth connecting tube 56.

In the foregoing embodiments, for a single-loop tube-and-belt structure, the refrigerant flow resistance is relatively small, and therefore the present invention is applicable to a heat exchange assembly with a relatively small overall size. For a multi-loop tube-and-belt structure, the refrigerant flow resistance is relatively large, and therefore the multi-loop tube-and-belt structure is applicable to a heat exchange assembly with a relatively large overall size.

In all of the above embodiments, the heat exchange inlet portions and the heat exchange outlet portions are arranged at intervals at the bottom of the heat exchange assembly.

As shown in FIGS. 56 to 65, the embodiment of the present disclosure provides a heat exchanger, the second heat exchange portion 40 is a bent flat tube structure, the bent flat tube structure has a heat exchange inlet portion, a heat exchange outlet portion, and a bent heat exchange flow path structure which is in communication with both the heat exchange inlet portion and the heat exchange outlet portion. The edge of the bent flat tube structure encloses to form a triangle structure or a trapezoid structure.

By using the structure of the heat exchanger provided in the present embodiment, in specific use, the sheet metal member in the A-type heat exchanger can be replaced with the heat exchanger structure, and in this way, a wind shield effect on the A-type heat exchanger can be achieved, the compactness of the structure is improved, and at the same time, the overall heat exchange effect of the A-type heat exchanger can also be improved. Therefore, by using the heat exchanger provided in the present embodiment, the heat exchange performance of the heat exchanger A can be improved effectively.

In embodiment 14, the bent flat tube structure includes a fifth flat tube 4110, the fifth flat tube 4110 includes a plurality of fifth heat exchange tube sections 4111 spaced apart in the horizontal direction and communicating with each other, and the fifth heat exchange tube section 4111 extends in the vertical direction.

In the present embodiment, the heights of the plurality of fifth heat exchange tube sections 4111 increase first and then decrease, one end of the fifth flat tube 4110 forms a heat exchange inlet portion, and the other end of the fifth flat tube 4110 forms a heat exchange outlet portion. By means of such a structure arrangement, a bent flat tube structure can be formed by means of one bent fifth flat tube 4110, the structure is simple, the manufacture is easy to implement, and the manufacture cost is effectively reduced.

In the present embodiment, the heat exchanger further includes a first manifold 20 (which can be an inlet manifold) and a second manifold 30 (which can be an outlet manifold), the heat exchange inlet portion is connected with the first manifold 20, and the heat exchange outlet portion is connected with the second manifold 30.

The heat exchanger in the present embodiment is a single-loop tube-and-belt structure, and this structural form is considered when the overall size of the heat exchanger is relatively small.

Embodiment 15 of the present disclosure provides a heat exchanger. in the present embodiment, a bent flat tube structure includes a fifth flat tube 4110, the fifth flat tube 4110 includes a plurality of fifth heat exchange tube sections 4111 spaced apart in a horizontal direction and communicating with each other, and the fifth heat exchange tube sections 4111 all extend in a vertical direction. There are a plurality of fifth flat tubes 4110, the plurality of fifth flat tubes 4110 being arranged at intervals in a horizontal direction, the heat exchange inlet portion includes a plurality of fifth heat exchange inlets of the fifth flat tubes 4110, the heat exchange outlet portion includes a plurality of fifth heat exchange outlets of the fifth flat tubes 4110, the heights of the plurality of fifth heat exchange tube sections 4111 of the plurality of fifth flat tubes 4110 increase first and then decrease. With such structure arrangement, by means of the plurality of fifth flat tubes 4110 spaced apart in the horizontal direction, the edge of the bent flat tube can enclose to form a triangular structure or a trapezoid structure. In addition, by arranging a plurality of fifth flat tubes 4110, compared with the structure of one flat tube, the length of the heat exchange flow path in each fifth flat tube 4110 can be reduced, thereby reducing the heat exchange resistance of the refrigerant, and facilitating improvement of the heat exchange effect.

In the present embodiment, the plurality of first heat exchange inlets are arranged at intervals, and the plurality of first heat exchange outlets are arranged at intervals. The heat exchanger further includes: a first connecting pipeline 120, the plurality of first heat exchange inlets being connected with the first connecting pipeline 120, and the first connecting pipeline 120 extending in a direction in which the plurality of first heat exchange inlets are disposed at intervals; or a second connecting pipeline 130, the plurality of first heat exchange outlets being connected with the second connecting pipeline 130, and the second connecting pipeline 130 extending in a direction in which the plurality of first heat exchange outlets are disposed at intervals.

In the present embodiment, the heat exchanger further includes a first connecting pipeline 120 and a second connecting pipeline 130, the plurality of first heat exchange inlets are all connected with the first connecting pipeline 120, and the first connecting pipeline 120 extends in a direction in which the plurality of first heat exchange inlets are disposed at intervals; the plurality of first heat exchange outlets are all connected with the second connecting pipeline 130, and the second connecting pipeline 130 extends in a direction in which the plurality of first heat exchange outlets are disposed at intervals. Such a structural arrangement facilitates supply of the refrigerant to the plurality of first heat exchange inlets respectively by means of the first connecting pipeline 120, and the refrigerant flowing out of the plurality of first heat exchange outlets can be collected conveniently by means of the second connecting pipeline 130.

The heat exchanger in the present embodiment is a multi-loop tube-and-belt structure, and the structure can be considered when the size of the heat exchanger is relatively long, thereby avoiding a large flow resistance of the refrigerant is large, and avoiding affecting the heat exchange performance.

Embodiment 16 of the present disclosure provides a heat exchanger, a bent flat tube structure includes a fifth flat tube 4110, the fifth flat tube 4110 includes a plurality of fifth heat exchange tube sections 4111 spaced apart in a horizontal direction and communicating with each other, and the fifth heat exchange tube sections 4111 all extend in a vertical direction. In the present embodiment, the heights of the plurality of the fifth heat exchange tube sections 4111 of the fifth flat tubes 4110 increase first and then decrease, there are a plurality of fifth flat tubes 4110, and the plurality of fifth flat tubes 4110 are disposed at intervals in the vertical direction. By means of such a structural arrangement, the number of heat exchange flow paths can be increased effectively, and the heat exchange effect is improved effectively. The structure in the present embodiment is a plurality of single-loop tube-and-belt structure, and is also applicable to a smaller-sized heat exchanger.

In the present embodiment, the heat exchanger includes a first manifold 20 and a second manifold 30, the heat exchange inlet portion includes a plurality of first heat exchange inlets of the fifth flat tubes 4110, the heat exchange outlet portion includes a plurality of first heat exchange outlets of the fifth flat tubes 4110, and the plurality of first heat exchange inlets are all connected with the first manifold 20, and the plurality of first heat exchange outlets are all connected with the second manifold 30.

Embodiment 17 of the present disclosure provides a heat exchanger. A bent flat tube structure in the present embodiment includes a fifth flat tube 4110, the fifth flat tube 4110 includes a plurality of fifth heat exchange tube sections 4111 spaced apart in a horizontal direction and communicating with each other, and the fifth heat exchange tube sections 4111 all extend in a vertical direction. The heights of the plurality of fifth heat exchange tube sections 4111 of the fifth flat tube 4110 of the heat exchanger increase first and then decrease, the bent flat tube structure further includes: a sixth flat tube 4120, the sixth flat tube 4120 including a plurality of sixth heat exchange tube sections 4121 spaced apart in the horizontal direction and communicating with each other, the sixth heat exchange tube sections 4121 extending in the vertical direction, the plurality of sixth heat exchange tube sections 4121 having the same height, and the plurality of fifth heat exchange tube sections 4111 being installed above the plurality of sixth heat exchange tube sections 4121. By means of such a structure arrangement, a bent flat tube structure with triangular or trapezoid edge can be formed conveniently. In addition, the structure layout of the heat exchange assembly is also optimized by arranging the layout of the fifth flat tubes 4110 and the sixth flat tubes 4120, thereby improving the structural compactness of the heat exchanger, reducing the length of the heat exchange flow path in each flat tube, and further reducing the flow resistance in the corresponding flat tube.

Embodiment 18 of the present disclosure provides a heat exchanger, the bent flat tube structure includes: a plurality of first inclined sections 4131 and a plurality of second inclined sections 4141, the plurality of first inclined sections 4131 and the plurality of second inclined sections 4141 being disposed in a one-to-one correspondingly manner, each of the first inclined sections 4131 is arranged corresponding to the corresponding second inclined section 4141, so as to be spliced to form a triangular structure. The plurality of first inclined sections 4131 are spaced apart in the horizontal direction, the plurality of second inclined sections 4141 are spaced apart in the horizontal direction, the first inclined section 4131 located at the outermost side and the second inclined section 4141 located at the outermost side form the edges of a bent flat tube structure and enclose to form a triangular structure or a trapezoid structure.

Embodiment 19 of the present disclosure provides a heat exchange assembly, in the present embodiment, the bent flat tube structure includes a seventh flat tube 4130 and an eighth flat tube 4140, the seventh flat tube 4130 including a plurality of third heat exchange tube sections spaced apart in the horizontal direction and communicating with each other, the eighth flat tube 4140 includes a plurality of fourth heat exchange tube sections spaced apart in the horizontal direction and communicating with each other, each of the third heat exchange tube sections include a first inclined section 4131, each of the fourth heat exchange tube sections includes a second inclined section 4141, the plurality of first inclined sections 4131 and the plurality of second inclined sections 4141 are disposed in a one-to-one correspondingly manner, and each of the first inclined sections 4131 abuts against the corresponding second inclined section 4141 to form a triangular structure. By means of such a structure arrangement, the structure layout of the bent flat tube structure can be optimized, and the compactness of the structure arrangement can be improved. In the present embodiment, the third heat exchange tube section further includes a first vertical section 4132, the first vertical section 4132 being located below the first inclined section 4131 and communicating with the first inclined section 4131, and the fourth heat exchange tube section further includes a second vertical section 4142, the second vertical section 4142 being located below the second inclined section 4141 and communicating with the second inclined section 4141.

In some embodiments, the heat exchanger can further include a tenth flat tube 4160, the tenth flat tube 4160 is located between the seventh flat tube 4130 and the eighth flat tube 4140, the tenth flat tube 4160 has a sixth heat exchange tube section, a seventh heat exchange tube section and an eighth heat exchange tube section spaced apart in the horizontal direction and communicating with each other, the sixth heat exchange tube section includes a sixth vertical section and a sixth inclined section connected with each other, the sixth inclined section is located above the sixth vertical section, the seventh heat exchange tube section includes a seventh vertical section, the eighth heat exchange tube section includes an eighth vertical section and an eighth inclined section which are connected with each other, and the eighth inclined section is located above the eighth vertical section. The sixth heat exchange tube section is disposed close to the third heat exchange tube section, the seventh heat exchange tube section is disposed close to the fourth heat exchange tube section, the sixth inclined section and the eighth inclined section enclose to form a triangular structure, and the seventh vertical section is partially located within a triangular region surrounded by the sixth inclined section and the eighth inclined section. With such a structural arrangement, the heat exchanger includes the seventh flat tube 4130, the eighth flat tube 4140 and the tenth flat tube 4160, so that the structural layout of the heat exchanger can be optimized, the structural compactness of the heat exchanger is improved, and the length of the heat exchange flow path in the flat tube can also be reduced, thereby reducing the heat exchange resistance.

In some embodiments, the heat exchanger further includes a third connecting pipeline 140 and a fourth connecting pipeline 150, the heat exchange inlet portion includes a third heat exchange inlet of the seventh flat tube 4130, a fourth heat exchange inlet of the eighth flat tube 4140, and a sixth heat exchange inlet of the tenth flat tube 4160; and the heat exchange outlet portion includes a third heat exchange outlet of the seventh flat tube 4130, a fourth heat exchange outlet of the eighth flat tube 4140, and a sixth heat exchange outlet of the tenth flat tube 4160. The third connecting pipeline 140 extends in a direction in which the third heat exchange inlet, the fourth heat exchange inlet and the sixth heat exchange inlet are disposed at intervals; and the third heat exchange inlet, the fourth heat exchange inlet and the sixth heat exchange inlet are all connected with the third connecting pipeline 140. The fourth connecting pipeline 150 extends in a direction in which the third heat exchange outlet, the fourth heat exchange outlet and the sixth heat exchange outlet are disposed at intervals; and the third heat exchange outlet, the fourth heat exchange outlet and the sixth heat exchange outlet are all connected with the fourth connecting pipeline 150.

Embodiment 7 of the present disclosure provides a heat exchanger, a bent flat tube structure of the heat exchanger includes: a ninth flat tube 4150, the ninth flat tube 4150 including a plurality of fifth heat exchange tube sections spaced apart in the vertical direction and communicating with each other, each of the fifth heat exchange tube sections including a third inclined section 4151 and a fourth inclined section 4152 connected to each other, and the third inclined section 4151 and the fourth inclined section 4152 enclosing to form a triangular structure. By means of such a structural arrangement, the structural layout of the heat exchanger can be optimized, the structural compactness of the heat exchanger is improved, and the triangular structure is also formed by enclosure conveniently.

In the present embodiment, a third vertical section 4153 is disposed at one end of the third inclined section 4151 away from the fourth inclined section 4152, and a fourth vertical section 4154 is disposed at one end of the fourth inclined section 4152 away from the third inclined section 4151.

In the present embodiment, there are a plurality of ninth flat tubes 4150, and the plurality of ninth flat tubes 4150 are disposed at intervals in a direction from an outer side to an inner side of the triangular structure. There are two ninth flat tubes 4150, wherein an installation region is provided between the fifth heat exchange inlet and the ninth heat exchange outlet of one fifth flat tube 4150, and the other ninth flat tube 4150 is installed in the installation region. The structure is compact in layout.

In the present embodiment, the heat exchanger further includes a fifth connecting pipeline 160 and a sixth connecting pipeline 170, the plurality of fifth heat exchange inlets are all connected with the fifth connecting pipeline 160, and the plurality of sixth heat exchange inlets are all connected with the sixth connecting pipeline 170.

In the foregoing embodiments, for a single-loop tube-and-belt structure, the refrigerant flow resistance is relatively small, and therefore the present invention is applicable to a heat exchanger with a relatively small overall size. For a multi-loop tube-and-belt structure, the refrigerant flow resistance is relatively large, and therefore the multi-loop tube-and-belt structure is applicable to a heat exchanger with a relatively large overall size.

In all of the above embodiments, the heat exchange inlet portion and the heat exchange outlet portion are arranged at intervals at the bottom of the heat exchanger.

The embodiments of the present disclosure achieve the following technical effects: increasing the heat exchange area, improving the heat exchange performance, optimizing the area layout of the heat exchanger, fully utilizing the area of the heat exchanger, improving the compactness of the structural arrangement, and effectively functioning as a wind shield.

It should be noted that the terms used herein are for the purpose of describing particular embodiments only and are not intended to limit exemplary embodiments in accordance with the present disclosure. As used herein, the singular form is intended to include the plural form as well, unless the context clearly indicates otherwise, and further it should be understood that the terms “includes” and/or “including”

when used in the present description, specify the presence of features, steps, operations, devices, components and/or combinations thereof.

The relative arrangement of components and steps, numerical expressions and numerical values set forth in these embodiments do not limit the scope of the disclosure unless specifically stated otherwise. Moreover, it should be understood that for the convenience of description, the dimensions of the parts shown in the drawings are not drawn according to the actual proportional relationship. Techniques, methods and devices known to a person of ordinary skill in the relevant art may not be discussed in detail, but the techniques, methods and devices shall be considered as a part of the description to be granted, where appropriate. In all examples shown and discussed herein, any specific values shall be construed as exemplary only and not as limiting. Therefore, other examples of the exemplary embodiments may have different values. It should be noted that similar numerals and letters represent similar items in the following figures, and thus once an item is defined in a figure, it need not be further discussed in subsequent figures.

In the description of the present disclosure, it should be understood that a direction or positional relationship indicated by the directional terms such as "before", "after", "upper", "lower", "left", "right", "lateral", "longitudinal", "vertical", "perpendicular", "horizontal", "top" and "bottom" is generally a direction or positional relationship based on the illustration in the drawings, and is merely intended for ease or brevity of description of this disclosure. Unless otherwise specified to the contrary, such directional terms do not indicate or imply that the indicated device or component is necessarily in the specified direction or necessarily constructed or operated in the specified direction. Therefore, such terms are not to be understood as a limitation on the protection scope of this disclosure. The directional terms "in" and "out" used in connection with a part mean inward and outward directions relative to the contour of the part.

In order to facilitate description, a spatial relative term may be used here, such as "over", "above", "on an upper surface" and "on", to describe a spatial location relation between a device or a feature shown in the drawing and other devices or other features. It is to be understood that the spatial relative term aims at including different orientations of the device during use or operation outside the orientation described in the drawing. For example, if the device in the drawing is inverted, it may be described as that the device "above other devices or other structures" or "over other devices or other structures" shall be positioned "under other devices or other structures" or "below other devices or other structures". Therefore, an exemplary term "above" may include two orientations: "above" and "under". The device may be positioned in various other ways as well (rotating 90 degrees or at other orientations), and the spatially relative descriptions used herein are to be construed accordingly.

In addition, it should be noted that, the use of "first", "second" and other terms to limit parts, is only to facilitate the distinction between the corresponding parts. If not otherwise stated, the above terms have no special meaning, and therefore cannot be interpreted as restrictions on the protection scope of the present disclosure.

The content above merely relates to preferred embodiments of the present disclosure and is not intended to limit the present disclosure. For a person skilled in the art, the present disclosure may have various modifications and variations. Any modifications, equivalent replacements, improvements, etc. made within the spirit and principle of the present disclosure shall all belong to the scope of protection of the present disclosure.

What is claimed is:

1. A triangular heat exchanger, comprising:

a first heat exchange portion, wherein the first heat exchange portion comprises a plurality of first flat tubes disposed at intervals, each of the plurality of first flat tubes comprises a first heat exchange tube section and a second heat exchange tube section connected with each other, and the first heat exchange tube section and the second heat exchange tube section are disposed at a preset angle; or the first heat exchange portion comprises a first heat exchange assembly and a second heat exchange assembly connected with each other, the first heat exchange assembly comprises a plurality of first heat exchange flat tubes disposed at intervals in a first preset direction, the second heat exchange assembly comprises a plurality of second heat exchange flat tubes disposed at intervals in a second preset direction, and the first preset direction is disposed at a preset angle to the second preset direction;

a first manifold and a second manifold, wherein first heat exchange tube sections of the plurality of first flat tubes are all connected with the first manifold, and second heat exchange tube sections of the plurality of first flat tubes are connected with the second manifold; or the plurality of first heat exchange flat tubes are all connected with the first manifold, and the plurality of second heat exchange flat tubes are all connected with the second manifold; and a second heat exchange portion disposed at an end portion of the first heat exchange portion, the first heat exchange portion and the second heat exchange portion enclosing to form an air duct;

wherein an installation region is provided between the first heat exchange tube sections and the second heat exchange tube sections, and the second heat exchange portion is disposed in the installation region;

wherein the installation region is a triangular region;

wherein there are two second heat exchange portions, the two second heat exchange portions are respectively disposed at two ends of the first heat exchange portion, inlet ends of the two second heat exchange portions are connected by means of a first connecting tube, and outlet ends of the two second heat exchange portions are connected by means of a second connecting tube;

the triangular heat exchanger further comprises a third connecting tube and a fourth connecting tube that are disposed at intervals, the third connecting tube and the fourth connecting tube are both disposed on one of the two second heat exchange portions, the third connecting tube is disposed between the one of the two second heat exchange portions and the first manifold, and the fourth connecting tube is disposed between the one of the two second heat exchange portions and the second manifold;

or the two second heat exchange portions and the first heat exchange portion are disposed independently of each other, so that the two second heat exchange portions and the first heat exchange portion exchange heat independently.

2. The triangular heat exchanger as claimed in claim 1, wherein the second heat exchange portion is of a triangular structure or a trapezoidal structure fitting the installation region, and the second heat exchange portion is at least partially fitted to the first heat exchange tube sections and the second heat exchange tube sections.

3. The triangular heat exchanger as claimed in claim 2, wherein an angle between the first heat exchange tube section and the second heat exchange tube section forms an apex angle of the triangular region, and the apex angle of the triangular region is as same as an apex angle of the triangular structure;

or wherein the second heat exchange portion comprises a second flat tube, the second flat tube comprises a plurality of bent tube sections connected in sequence, and heights of the plurality of bent tube sections connected in sequence gradually increase first and then gradually decrease, so that edges of the plurality of bent tube sections connected in sequence enclose to form the triangular structure;

or wherein the second heat exchange portion comprises a second flat tube and second fins, the second flat tube comprises a plurality of bent tube sections connected in sequence, and heights of the plurality of bent tube sections connected in sequence gradually increase first and then gradually decrease, there are a plurality of second fins, and the plurality of second fins are installed in a bending gap of each of the plurality of bent tube sections connected in sequence and between two adjacent bent tube sections of the plurality of bent tube sections connected in sequence; wherein the two adjacent bent tube sections of the plurality of bent tube sections connected in sequence comprise a first bent tube section and a second bent tube section, a height of the first bent tube section, a height of a second fin of the plurality of second fins disposed between the first bent tube section and the second bent tube section, and a height of the second bent tube section gradually increases or decreases in sequence, so that an edge of the second flat tube and edges of the plurality of second fins enclose to form the triangular structure.

4. The triangular heat exchanger as claimed in claim 1, wherein an inlet end of the second heat exchange portion is in communication with the first manifold, and an outlet end of the second heat exchange portion is in communication with the second manifold;

or wherein the second heat exchange portion comprises a second flat tube; a first insertion slot is disposed on the first manifold, the first insertion slot extends in an axial direction of the first manifold, and one end of the second flat tube is inserted into the first insertion slot; and a second insertion slot is arranged on the second manifold, the second insertion slot extends in an axial direction of the second manifold, and an other end of the second flat tube is inserted into the second insertion slot;

or wherein the second heat exchange portion comprises a third manifold, a fourth manifold and a second flat tube, the second flat tube is in communication with the third manifold and the fourth manifold respectively, and the third manifold and the fourth manifold are in communication with the first manifold and the second manifold respectively by means of connecting tubes.

* * * * *